US011478043B2

(12) United States Patent
Ng

(10) Patent No.: US 11,478,043 B2
(45) Date of Patent: Oct. 25, 2022

(54) MANUAL AND DYNAMIC SHOE COMFORTNESS ADJUSTMENT METHODS

(71) Applicant: Hoe-Phuan Ng, Colorado Springs, CO (US)

(72) Inventor: Hoe-Phuan Ng, Colorado Springs, CO (US)

( * ) Notice: Subject to any disclaimer, the term of this patent is extended or adjusted under 35 U.S.C. 154(b) by 0 days.

(21) Appl. No.: 17/079,295

(22) Filed: Oct. 23, 2020

(65) Prior Publication Data

US 2021/0037915 A1 Feb. 11, 2021

Related U.S. Application Data

(62) Division of application No. 15/405,570, filed on Jan. 13, 2017, now Pat. No. 10,856,610.

(60) Provisional application No. 62/279,343, filed on Jan. 15, 2016.

(51) Int. Cl.

| | |
|---|---|
| ***A43B 13/18*** | (2006.01) |
| ***A43B 17/02*** | (2006.01) |
| ***A43B 17/00*** | (2006.01) |

(52) U.S. Cl.

CPC ..... *A43B 13/186* (2013.01); *A43B 13/183* (2013.01); *A43B 13/184* (2013.01); *A43B 13/188* (2013.01); *A43B 17/006* (2013.01); *A43B 17/023* (2013.01)

(58) Field of Classification Search

CPC ... A43B 13/186; A43B 13/183; A43B 13/184; A43B 13/188; A43B 17/006; A43B 17/023

See application file for complete search history.

(56) References Cited

U.S. PATENT DOCUMENTS

| | | | |
|---|---|---|---|
| 22,755 | A | 1/1859 | Thorn |
| 182,648 | A | 9/1876 | Dilley et al. |
| 413,693 | A | 10/1889 | Walker |
| 564,767 | A | 7/1896 | Schneider |
| 622,673 | A | 4/1899 | Ferrata |
| 889,093 | A | 5/1908 | Bemis |
| RE13,150 | E | 9/1910 | Byrne |
| 975,576 | A | 11/1910 | Sexton |
| 1,088,328 | A | 2/1914 | Cucinotta |
| 1,098,241 | A | 5/1914 | Forray |
| 1,136,443 | A | 4/1915 | Scholl |
| 1,146,597 | A | 7/1915 | Scholl |
| 1,208,638 | A | 12/1916 | Phillips |
| 1,221,632 | A | 4/1917 | Tysse |
| 1,242,363 | A | 10/1917 | Mueller et al. |
| 1,364,226 | A | 1/1921 | Wherry |
| 1,380,879 | A | 6/1921 | Young |
| 1,403,970 | A | 1/1922 | Lioy |
| 1,404,822 | A | 1/1922 | Williams |
| 1,502,087 | A | 7/1924 | Bunns |

(Continued)

FOREIGN PATENT DOCUMENTS

| | | |
|---|---|---|
| EP | 0456434 A3 | 8/1992 |
| EP | 1417901 A1 | 5/2004 |

*Primary Examiner* — Ted Kavanaugh

(74) *Attorney, Agent, or Firm* — Dorsey & Whitney LLP

(57) ABSTRACT

Disclosed herein are various methods and devices for modifying the comfort and performance characteristics of a shoe. In various embodiments, the devices are soles, insole or outsoles, of a shoe comprising one or more shocks. The shocks may be defined by shock cavities positioned within one or more surfaces of a sole. In some embodiments the shock cavity may be configured to receive one or more shock cavity inserts.

18 Claims, 17 Drawing Sheets

(56) References Cited

U.S. PATENT DOCUMENTS 1,640,301 A 8/1927 Alberto
1,702,531 A 2/1929 Ambill
1,754,054 A 4/1930 Selva
1,774,122 A 8/1930 Severin
1,813,561 A 7/1931 Salvatore
1,843,952 A 2/1932 Mcbrearty
1,872,641 A 8/1932 Capezio
1,953,659 A 4/1934 Savino
1,973,402 A 9/1934 Bohmbach
1,996,083 A 4/1935 Smith
2,113,183 A 4/1938 Sanchioni
2,299,009 A 10/1942 Denk
2,378,028 A 6/1945 Nimrick
2,437,227 A 3/1948 Hall
2,619,743 A 12/1952 Harris
2,626,610 A 1/1953 Mctavish et al.
2,668,374 A 2/1954 Seigle
2,669,038 A 2/1954 De Werth
2,710,460 A 6/1955 Stasinos
2,721,400 A 10/1955 Israel
2,773,316 A 12/1956 Clappier
2,863,230 A 12/1958 Cortina
2,897,611 A 8/1959 Schaller
2,930,149 A 3/1960 Hack et al.
2,968,105 A 1/1961 Rizzo
2,979,835 A 4/1961 Scholl
3,005,272 A 10/1961 Shelare et al.
3,180,039 A 4/1965 Burns, Jr.
3,181,254 A 5/1965 Cowen
3,225,463 A 12/1965 Burnham
3,253,355 A 5/1966 Menken
3,253,601 A 5/1966 Scholl
3,545,447 A 12/1970 Silverman
3,602,931 A 9/1971 Macarthur et al.
3,647,616 A 3/1972 Zemlin
3,716,930 A 2/1973 Brahm
3,766,669 A 10/1973 Pearsall
3,777,374 A 12/1973 Hendricks
3,790,150 A 2/1974 Lippert
3,828,792 A 8/1974 Valenta
4,026,044 A 5/1977 Senter
4,033,567 A 7/1977 Lipfert
4,055,699 A 10/1977 Hsiung
4,118,878 A 10/1978 Semon
4,187,620 A 2/1980 Selner
4,224,750 A 9/1980 Delport
4,227,321 A 10/1980 Kling et al.
4,232,457 A 11/1980 Mosher
4,235,028 A 11/1980 Riggs
4,262,433 A 4/1981 Hagg et al.
4,267,648 A 5/1981 Weisz
4,267,650 A 5/1981 Bauer
4,271,606 A 6/1981 Rudy
4,277,897 A 7/1981 O'Connell
4,283,864 A 8/1981 Lipfert
4,297,796 A 11/1981 Stirtz et al.
4,316,335 A 2/1982 Giese et al.
4,322,893 A 4/1982 Halvorsen
4,340,626 A 7/1982 Rudy
4,342,158 A 8/1982 Mcmahon et al.
4,345,387 A 8/1982 Daswick
4,356,642 A 11/1982 Herman
4,364,188 A 12/1982 Turner et al.
4,377,042 A 3/1983 Bauer
4,408,402 A 10/1983 Looney
4,413,430 A 11/1983 Brown
4,414,760 A 11/1983 Faiella
4,417,407 A 11/1983 Fukuoka
4,435,910 A 3/1984 Marc
4,451,994 A 6/1984 Fowler
4,525,940 A 7/1985 Mochizuki
4,535,553 A 8/1985 Derderian et al.
4,541,186 A 9/1985 Mulvihill
4,546,555 A 10/1985 Spademan
4,573,279 A 3/1986 Feurer-zogel et al.
4,597,196 A 7/1986 Brown
4,608,768 A 9/1986 Cavanagh
4,616,431 A 10/1986 Dassler
4,624,061 A 11/1986 Wezel et al.
4,627,178 A 12/1986 Sullivan et al.
4,627,179 A 12/1986 Mcelroy
4,633,598 A 1/1987 Moronaga et al.
4,656,760 A 4/1987 Tonkel et al.
4,674,204 A 6/1987 Sullivan et al.
4,680,875 A 7/1987 Danieli
4,709,489 A 12/1987 Welter
4,729,179 A 3/1988 Quist, Jr.
4,736,531 A 4/1988 Richard
4,742,625 A 5/1988 Sydor et al.
4,754,559 A 7/1988 Cohen
4,763,426 A 8/1988 Polus et al.
4,771,554 A 9/1988 Hannemann
4,774,774 A 10/1988 Allen, Jr.
4,776,109 A 10/1988 Sacre
4,782,605 A 11/1988 Chapnick
4,798,009 A 1/1989 Colonel et al.
4,800,657 A 1/1989 Brown
4,817,304 A 4/1989 Parker et al.
4,823,483 A 4/1989 Chapnick
4,843,738 A 7/1989 Masuda
4,843,741 A 7/1989 Yung-mao
4,845,863 A 7/1989 Yung-mao
4,876,805 A 10/1989 Peoples
4,879,821 A 11/1989 Graham et al.
4,887,367 A 12/1989 Mackness et al.
4,894,933 A 1/1990 Tonkel et al.
4,897,936 A 2/1990 Fuerst
4,901,390 A 2/1990 Daley
4,910,886 B1 5/1990 Sullivan et al.
4,924,605 A 5/1990 Spademan
4,930,232 A 6/1990 Engle
4,936,030 A 6/1990 Rennex
4,941,273 A 7/1990 Gross
4,942,677 A 7/1990 Flemming et al.
4,942,678 A 7/1990 Gumbert
4,977,691 A 12/1990 Orchard
D315,634 S 3/1991 Yung-mao
5,022,168 A 6/1991 Jeppson, III et al.
5,060,401 A 10/1991 Whatley
5,068,983 A 12/1991 Marc
5,077,916 A 1/1992 Beneteau
D324,940 S 3/1992 Claveria
5,109,613 A 5/1992 Van Dyke
5,111,597 A 5/1992 Hansen et al.
5,127,170 A 7/1992 Messina
5,134,790 A 8/1992 Woitschaetzke et al.
5,152,081 A 10/1992 Hallenbeck et al.
5,155,927 A 10/1992 Bates et al.
5,175,946 A 1/1993 Tsai
5,185,943 A 2/1993 Tong et al.
5,187,883 A 2/1993 Penney
5,187,885 A 2/1993 Murphy
5,189,816 A 3/1993 Shibata
5,195,257 A 3/1993 Holcomb et al.
5,212,878 A 5/1993 Burke et al.
5,220,791 A 6/1993 Bulzomi
5,224,277 A 7/1993 Sang
5,224,280 A 7/1993 Preman et al.
D340,349 S 10/1993 Kilgore et al.
D340,350 S 10/1993 Kilgore et al.
5,255,451 A 10/1993 Tong et al.
D342,824 S 1/1994 Bevier et al.
5,274,932 A 1/1994 Malloy
5,279,051 A 1/1994 Whatley
D344,174 S 2/1994 Kilgore
D344,398 S 2/1994 Kilgore
D344,399 S 2/1994 Kilgore
D344,400 S 2/1994 Kilgore
D344,401 S 2/1994 Kilgore
5,282,288 A 2/1994 Henson
5,282,326 A 2/1994 Schroer, Jr. et al.
D344,622 S 3/1994 Kilgore
5,311,674 A 5/1994 Santiyanont et al.
5,311,678 A 5/1994 Spademan

(56) References Cited

U.S. PATENT DOCUMENTS

| | | | |
|---|---|---|---|
| D348,766 | S | 7/1994 | Bevier et al. |
| D348,977 | S | 7/1994 | Koh |
| 5,331,750 | A | 7/1994 | Sasaki et al. |
| D350,018 | S | 8/1994 | Kilgore |
| D350,019 | S | 8/1994 | Kilgore |
| D350,020 | S | 8/1994 | Kilgore |
| 5,337,492 | A | 8/1994 | Anderie et al. |
| D350,225 | S | 9/1994 | Kilgore |
| D350,226 | S | 9/1994 | Kilgore |
| D350,227 | S | 9/1994 | Kilgore |
| D350,433 | S | 9/1994 | Kilgore |
| 5,343,637 | A | 9/1994 | Schindler |
| 5,343,639 | A | 9/1994 | Kilgore et al. |
| D351,057 | S | 10/1994 | Kilgore |
| D351,720 | S | 10/1994 | Kilgore |
| 5,353,523 | A | 10/1994 | Kilgore et al. |
| D351,936 | S | 11/1994 | Kilgore |
| D352,159 | S | 11/1994 | Kilgore |
| D352,160 | S | 11/1994 | Kilgore |
| 5,363,570 | A | 11/1994 | Allen et al. |
| 5,365,678 | A | 11/1994 | Shibata |
| 5,369,896 | A | 12/1994 | Frachey et al. |
| 5,372,487 | A | 12/1994 | Pekar |
| D354,617 | S | 1/1995 | Kilgore |
| 5,384,977 | A | 1/1995 | Chee |
| 5,396,718 | A | 3/1995 | Schuler et al. |
| 5,400,528 | A | 3/1995 | Skinner et al. |
| 5,410,821 | A | 5/1995 | Hilgendorf |
| 5,461,800 | A | 10/1995 | Luthi et al. |
| 5,493,792 | A | 2/1996 | Bates et al. |
| 5,533,280 | A | 7/1996 | Halliday |
| 5,544,431 | A | 8/1996 | Dixon |
| 5,544,432 | A | 8/1996 | Kita |
| 5,551,173 | A | 9/1996 | Chambers |
| 5,572,804 | A | 11/1996 | Skaja et al. |
| D376,471 | S | 12/1996 | Kalin et al. |
| 5,611,153 | A | 3/1997 | Fisher et al. |
| 5,619,809 | A | 4/1997 | Sessa |
| 5,628,128 | A | 5/1997 | Miller et al. |
| 5,632,103 | A | 5/1997 | Suenaga |
| 5,649,374 | A | 7/1997 | Chou |
| 5,657,556 | A | 8/1997 | Bemis |
| D383,894 | S | 9/1997 | Snyder et al. |
| D385,393 | S | 10/1997 | Wong |
| 5,678,330 | A | 10/1997 | Van Dyke et al. |
| 5,682,685 | A | 11/1997 | Terlizzi |
| RE35,708 | E | 1/1998 | Malloy |
| 5,718,063 | A | 2/1998 | Yamashita et al. |
| 5,720,118 | A | 2/1998 | Mayer et al. |
| D392,448 | S | 3/1998 | Backus |
| 5,746,011 | A | 5/1998 | Hedstroem |
| 5,766,704 | A | 6/1998 | Allen et al. |
| 5,768,803 | A | 6/1998 | Levy |
| 5,778,560 | A | 7/1998 | Danieli |
| 5,782,014 | A | 7/1998 | Peterson |
| 5,787,610 | A | 8/1998 | Brooks |
| D398,763 | S | 9/1998 | Selbiger |
| D398,769 | S | 9/1998 | Avar |
| 5,799,415 | A | 9/1998 | Kenji et al. |
| 5,799,417 | A | 9/1998 | Burke et al. |
| 5,822,886 | A | 10/1998 | Luthi et al. |
| 5,827,459 | A | 10/1998 | Allen et al. |
| 5,839,209 | A | 11/1998 | Healy et al. |
| D403,146 | S | 12/1998 | Wong |
| D403,847 | S | 1/1999 | Blythe |
| 5,860,225 | A | 1/1999 | O'Dwyer |
| 5,918,383 | A | 7/1999 | Wong |
| 5,933,984 | A | 8/1999 | Carlson et al. |
| 5,935,671 | A | 8/1999 | Lhuillier |
| 5,939,157 | A | 8/1999 | Allen et al. |
| 5,946,825 | A | 9/1999 | Koh et al. |
| 5,955,159 | A | 9/1999 | Allen et al. |
| 5,983,529 | A | 11/1999 | Serna |
| 5,985,383 | A | 11/1999 | Allen et al. |
| 6,006,447 | A | 12/1999 | Neal et al. |
| 6,006,449 | A | 12/1999 | Orlowski et al. |
| 6,023,857 | A | 2/2000 | Vizy et al. |
| 6,023,859 | A | 2/2000 | Burke et al. |
| 6,026,593 | A | 2/2000 | Harmon-Weiss et al. |
| 6,029,962 | A | 2/2000 | Shorten et al. |
| 6,041,521 | A | 3/2000 | Wong |
| 6,055,747 | A | 5/2000 | Lombardino |
| 6,076,284 | A | 6/2000 | Terlizzi |
| 6,098,313 | A | 8/2000 | Skaja |
| 6,098,319 | A | 8/2000 | Epstein |
| 6,101,655 | A | 8/2000 | Buddle |
| 6,102,412 | A | 8/2000 | Staffaroni |
| 6,115,943 | A | 9/2000 | Gyr |
| 6,131,309 | A | 10/2000 | Walsh |
| 6,170,175 | B1 | 1/2001 | Funk |
| 6,176,025 | B1 | 1/2001 | Patterson et al. |
| 6,199,304 | B1 | 3/2001 | Ludemann |
| 6,216,365 | B1 | 4/2001 | Cohen |
| 6,237,251 | B1 | 5/2001 | Litchfield et al. |
| 6,247,248 | B1 | 6/2001 | Clark |
| 6,247,251 | B1 | 6/2001 | James |
| 6,253,466 | B1 | 7/2001 | Harmon-Weiss et al. |
| 6,286,232 | B1 | 9/2001 | Snyder et al. |
| D450,437 | S | 11/2001 | Simpson et al. |
| D452,060 | S | 12/2001 | Estey |
| 6,354,020 | B1 | 3/2002 | Kimball et al. |
| 6,385,864 | B1 | 5/2002 | Sell, Jr. et al. |
| 6,389,711 | B1 | 5/2002 | Polegato |
| 6,393,731 | B1 | 5/2002 | Moua et al. |
| 6,405,455 | B1 | 6/2002 | Walsh |
| 6,405,459 | B1 | 6/2002 | Prevost et al. |
| 6,412,194 | B1 | 7/2002 | Carlson et al. |
| 6,453,578 | B1 | 9/2002 | Yung et al. |
| 6,457,261 | B1 | 10/2002 | Crary |
| 6,487,796 | B1 | 12/2002 | Avar et al. |
| D468,086 | S | 1/2003 | Mcdowell |
| D473,044 | S | 4/2003 | Mcdowell |
| D474,589 | S | 5/2003 | Dykes |
| 6,594,922 | B1 | 7/2003 | Mansfield et al. |
| 6,598,321 | B2 | 7/2003 | Crane et al. |
| 6,616,544 | B2 | 9/2003 | Kimmorley |
| 6,634,121 | B2 | 10/2003 | Sordi |
| 6,658,766 | B2 | 12/2003 | Kraeuter et al. |
| 6,691,432 | B2 | 2/2004 | Masseron |
| 6,722,058 | B2 | 4/2004 | Lucas et al. |
| 6,732,457 | B2 | 5/2004 | Gardiner |
| 6,748,675 | B2 | 6/2004 | Sato |
| 6,748,676 | B1 | 6/2004 | Chenevert |
| 6,749,187 | B2 | 6/2004 | Yang |
| 6,754,982 | B2 | 6/2004 | Reed et al. |
| 6,763,611 | B1 | 7/2004 | Fusco |
| 6,766,536 | B1 | 7/2004 | Aarons |
| 6,769,202 | B1 | 8/2004 | Luthi et al. |
| 6,785,985 | B2 | 9/2004 | Marvin et al. |
| 6,796,056 | B2 | 9/2004 | Swigart |
| 6,807,753 | B2 | 10/2004 | Steszyn et al. |
| 6,823,612 | B2 | 11/2004 | Manz et al. |
| 6,854,198 | B2 | 2/2005 | Brooks |
| 6,880,267 | B2 | 4/2005 | Smaldone et al. |
| 6,898,870 | B1 | 5/2005 | Rohde |
| 6,915,596 | B2 | 7/2005 | Grove et al. |
| 6,920,705 | B2 | 7/2005 | Lucas et al. |
| 6,922,919 | B2 | 8/2005 | Chenevert |
| 6,931,765 | B2 | 8/2005 | Lucas et al. |
| 6,931,766 | B2 | 8/2005 | Greene |
| 6,962,008 | B2 | 11/2005 | Manz et al. |
| 6,962,010 | B2 | 11/2005 | Huff |
| 6,964,120 | B2 | 11/2005 | Cartier et al. |
| 6,968,636 | B2 | 11/2005 | Aveni et al. |
| D512,821 | S | 12/2005 | Lee |
| 6,973,743 | B1 | 12/2005 | Mowery |
| 6,976,319 | B2 | 12/2005 | Pfander |
| 6,983,553 | B2 | 1/2006 | Lussier et al. |
| 6,983,555 | B2 | 1/2006 | Lacorazza et al. |
| 6,983,557 | B2 | 1/2006 | Manz et al. |
| 6,988,329 | B2 | 1/2006 | Marvin et al. |
| 7,000,334 | B2 | 2/2006 | Gillespie |
| 7,010,872 | B2 | 3/2006 | Pawlus et al. |
| 7,013,582 | B2 | 3/2006 | Lucas et al. |

(56) References Cited

U.S. PATENT DOCUMENTS

| | | | |
|---|---|---|---|
| 7,020,988 | B1 | 4/2006 | Holden et al. |
| 7,047,667 | B2 | 5/2006 | Klavano |
| 7,047,669 | B2 | 5/2006 | Polcek |
| 7,047,670 | B2 | 5/2006 | Marvin et al. |
| 7,047,672 | B2 | 5/2006 | Hoffer et al. |
| 7,051,458 | B2 | 5/2006 | Laduca |
| 7,069,665 | B1 | 7/2006 | Adriano |
| 7,073,276 | B2 | 7/2006 | Swigart |
| 7,076,890 | B2 | 7/2006 | Grove et al. |
| 7,082,698 | B2 | 8/2006 | Smaldone et al. |
| 7,107,235 | B2 | 9/2006 | Lyden |
| 7,107,704 | B2 | 9/2006 | Dennis et al. |
| 7,107,705 | B2 | 9/2006 | Dalton et al. |
| 7,108,252 | B2 | 9/2006 | Jayakumaran |
| D531,792 | S | 11/2006 | Roulo |
| 7,140,124 | B2 | 11/2006 | Manz et al. |
| 7,140,126 | B2 | 11/2006 | Crane et al. |
| 7,140,129 | B2 | 11/2006 | Newson et al. |
| 7,152,625 | B2 | 12/2006 | Marvin et al. |
| 7,168,188 | B2 | 1/2007 | Auger et al. |
| 7,171,767 | B2 | 2/2007 | Hatfield et al. |
| D540,015 | S | 4/2007 | Mcclaskie |
| D540,016 | S | 4/2007 | Mcclaskie |
| 7,200,955 | B2 | 4/2007 | Foxen |
| 7,204,044 | B2 | 4/2007 | Hoffer et al. |
| 7,207,125 | B2 | 4/2007 | Jeppesen et al. |
| D542,515 | S | 5/2007 | Amado et al. |
| 7,219,449 | B1 | 5/2007 | Hoffberg et al. |
| D544,689 | S | 6/2007 | Link |
| 7,225,491 | B2 | 6/2007 | Reed et al. |
| 7,225,564 | B1 | 6/2007 | Gillespie |
| D547,534 | S | 7/2007 | Schindler et al. |
| 7,243,443 | B2 | 7/2007 | Swigart |
| 7,243,445 | B2 | 7/2007 | Manz et al. |
| 7,249,425 | B2 | 7/2007 | Wang |
| D549,432 | S | 8/2007 | Mcclaskie |
| 7,272,900 | B1 | 9/2007 | Epstein |
| 7,278,226 | B2 | 10/2007 | Holden et al. |
| 7,278,445 | B2 | 10/2007 | Marvin et al. |
| 7,284,344 | B2 | 10/2007 | Pawlus et al. |
| 7,290,357 | B2 | 11/2007 | Mcdonald et al. |
| D558,964 | S | 1/2008 | Truelsen |
| 7,314,125 | B2 | 1/2008 | Smaldone et al. |
| 7,314,222 | B2 | 1/2008 | Borel et al. |
| D561,984 | S | 2/2008 | Truelsen |
| 7,328,524 | B2 | 2/2008 | Lebo |
| 7,334,352 | B2 | 2/2008 | Lacey |
| 7,337,558 | B2 | 3/2008 | Terlizzi et al. |
| 7,337,560 | B2 | 3/2008 | Marvin et al. |
| 7,340,851 | B2 | 3/2008 | Litchfield et al. |
| D566,960 | S | 4/2008 | Rivas et al. |
| 7,350,320 | B2 | 4/2008 | Chandler et al. |
| 7,377,057 | B2 | 5/2008 | Lacorazza et al. |
| D570,079 | S | 6/2008 | Truelsen |
| D570,582 | S | 6/2008 | Roy et al. |
| D571,543 | S | 6/2008 | Sungadi |
| 7,380,350 | B2 | 6/2008 | Meschan et al. |
| D572,887 | S | 7/2008 | Byrne et al. |
| D573,336 | S | 7/2008 | Rivas et al. |
| 7,392,605 | B2 | 7/2008 | Hatfield et al. |
| 7,401,418 | B2 | 7/2008 | Wyszynski et al. |
| 7,401,419 | B2 | 7/2008 | Lucas et al. |
| D574,129 | S | 8/2008 | Truelsen |
| 7,421,805 | B2 | 9/2008 | Geer |
| 7,426,792 | B2 | 9/2008 | Swigart et al. |
| 7,444,763 | B2 | 11/2008 | Grove et al. |
| 7,444,767 | B2 | 11/2008 | Kilgore et al. |
| 7,448,149 | B2 | 11/2008 | Preskar et al. |
| 7,451,557 | B2 | 11/2008 | Mcdonald et al. |
| 7,458,172 | B2 | 12/2008 | Aveni |
| 7,464,489 | B2 | 12/2008 | Ho |
| 7,484,318 | B2 | 2/2009 | Finkelstein |
| 7,493,708 | B2 | 2/2009 | Crowley, Jr. |
| 7,513,067 | B2 | 4/2009 | Marvin et al. |
| 7,526,880 | B2 | 5/2009 | Polcek |
| 7,533,477 | B2 | 5/2009 | Goodwin et al. |
| 7,536,809 | B2 | 5/2009 | Meschan |
| 7,540,099 | B2 | 6/2009 | Meschan et al. |
| 7,543,399 | B2 | 6/2009 | Kilgore et al. |
| 7,546,695 | B2 | 6/2009 | Aveni et al. |
| 7,565,754 | B1 | 7/2009 | Acheson et al. |
| 7,574,817 | B2 | 8/2009 | Fechter |
| 7,578,076 | B2 | 8/2009 | Pawlus et al. |
| 7,596,888 | B2 | 10/2009 | Meschan et al. |
| 7,607,241 | B2 | 10/2009 | Mcdonald et al. |
| 7,644,518 | B2 | 1/2010 | Chandler et al. |
| 7,665,232 | B2 | 2/2010 | Manz et al. |
| D611,237 | S | 3/2010 | Torrance et al. |
| 7,673,400 | B2 | 3/2010 | Brown et al. |
| 7,685,741 | B2 | 3/2010 | Friedman |
| 7,685,743 | B2 | 3/2010 | Swigart et al. |
| 7,707,743 | B2 | 5/2010 | Schindler et al. |
| 7,721,465 | B2 | 5/2010 | Marvin et al. |
| D616,637 | S | 6/2010 | Taestensen |
| 7,730,634 | B2 | 6/2010 | Laduca |
| 7,730,635 | B2 | 6/2010 | Aveni et al. |
| 7,730,636 | B2 | 6/2010 | Auger et al. |
| 7,730,637 | B2 | 6/2010 | Scholz |
| 7,735,241 | B2 | 6/2010 | Marvin et al. |
| D618,894 | S | 7/2010 | Taestensen |
| D620,244 | S | 7/2010 | Taestensen |
| 7,748,141 | B2 | 7/2010 | Smith et al. |
| 7,752,775 | B2 | 7/2010 | Lyden |
| 7,757,410 | B2 | 7/2010 | Aveni et al. |
| 7,762,009 | B2 | 7/2010 | Gerber |
| 7,770,306 | B2 | 8/2010 | Lyden |
| 7,774,955 | B2 | 8/2010 | Goodwin et al. |
| 7,793,428 | B2 | 9/2010 | Shenone |
| 7,794,368 | B2 | 9/2010 | Rutherford |
| 7,798,298 | B2 | 9/2010 | Smaldone et al. |
| D625,909 | S | 10/2010 | Skaja et al. |
| 7,805,859 | B2 | 10/2010 | Finkelstein |
| 7,810,256 | B2 | 10/2010 | Goodwin et al. |
| 7,814,682 | B2 | 10/2010 | Grove et al. |
| 7,818,897 | B2 | 10/2010 | Geer |
| 7,832,118 | B2 | 11/2010 | Holden et al. |
| 7,832,123 | B2 | 11/2010 | Fallon et al. |
| 7,841,105 | B2 | 11/2010 | Wyszynski et al. |
| 7,854,076 | B2 | 12/2010 | Keppler et al. |
| D630,419 | S | 1/2011 | Torrance et al. |
| 7,886,461 | B2 | 2/2011 | Sato |
| D634,524 | S | 3/2011 | Pauk et al. |
| D634,922 | S | 3/2011 | Pauk et al. |
| 7,905,034 | B2 | 3/2011 | Robinson, Jr. et al. |
| D636,983 | S | 5/2011 | Torrance et al. |
| D637,380 | S | 5/2011 | Niedner et al. |
| 7,941,875 | B1 | 5/2011 | Doctor et al. |
| 7,941,943 | B2 | 5/2011 | Baker et al. |
| 7,946,058 | B2 | 5/2011 | Johnson et al. |
| 7,946,059 | B2 | 5/2011 | Borel |
| 7,950,091 | B2 | 5/2011 | Auger et al. |
| 7,950,168 | B2 | 5/2011 | Nakano |
| 7,950,169 | B2 | 5/2011 | Holt et al. |
| 7,954,257 | B2 | 6/2011 | Banik |
| 7,954,259 | B2 | 6/2011 | Antonelli et al. |
| 7,958,653 | B2 | 6/2011 | Howlett et al. |
| 7,962,986 | B2 | 6/2011 | Dananberg |
| 7,966,748 | B2 | 6/2011 | Votolato |
| D641,143 | S | 7/2011 | Niedner et al. |
| D641,545 | S | 7/2011 | Niedner et al. |
| 7,979,936 | B2 | 7/2011 | Aveni |
| 7,980,006 | B2 | 7/2011 | Aveni et al. |
| 7,992,324 | B2 | 8/2011 | Lacorazza et al. |
| 8,006,408 | B2 | 8/2011 | Leedy et al. |
| 8,006,411 | B2 | 8/2011 | Manz et al. |
| D645,652 | S | 9/2011 | Torrance et al. |
| 8,011,118 | B2 | 9/2011 | Gerber |
| 8,020,317 | B1 | 9/2011 | Sokolowski |
| 8,020,318 | B2 | 9/2011 | Khalifa |
| 8,033,034 | B2 | 10/2011 | Jarosik |
| 8,037,623 | B2 | 10/2011 | Passke et al. |
| 8,051,584 | B2 | 11/2011 | Robson et al. |
| 8,056,263 | B2 | 11/2011 | Schindler et al. |
| 8,061,060 | B2 | 11/2011 | Swigart et al. |

(56) References Cited

U.S. PATENT DOCUMENTS 8,069,498 B2 12/2011 Maddux et al.
8,112,906 B2 2/2012 Paik
8,122,614 B2 2/2012 Sussmann
8,122,615 B2 2/2012 Lucas et al.
D655,555 S 3/2012 Benson
8,127,469 B2 3/2012 Keenan et al.
8,146,270 B2 4/2012 Aveni et al.
8,151,489 B2 4/2012 Marvin et al.
8,166,674 B2 5/2012 Dananberg
8,196,320 B2 6/2012 Adami et al.
8,209,883 B2 7/2012 Lyden
8,220,183 B2 7/2012 Evans et al.
8,246,881 B2 8/2012 Maranan et al.
8,261,469 B2 9/2012 Aveni et al.
D669,674 S 10/2012 Vidal
8,302,234 B2 11/2012 Goodwin et al.
8,302,328 B2 11/2012 Goodwin et al.
8,303,885 B2 11/2012 Hatfield et al.
8,312,643 B2 11/2012 Goodwin et al.
8,322,048 B2 12/2012 Aveni et al.
8,333,024 B2 12/2012 Fallow et al.
8,348,031 B2 1/2013 Smaldone et al.
D676,637 S 2/2013 Hane
8,381,417 B2 2/2013 Crowley, II et al.
D677,869 S 3/2013 Labarbera et al.
D679,058 S 3/2013 Szalkowski et al.
8,387,279 B2 3/2013 Pauk et al.
D681,930 S 5/2013 Hansen
D683,079 S 5/2013 Schmidt et al.
D683,118 S 5/2013 Pauk
8,453,344 B2 6/2013 Nishiwaki et al.
8,453,345 B2 6/2013 Evans et al.
8,474,155 B2 7/2013 Mcdonald et al.
8,479,414 B2 7/2013 Baker et al.
8,484,865 B2 7/2013 Baker et al.
8,510,974 B2 8/2013 Yue et al.
8,516,723 B2 8/2013 Ferrigan et al.
8,522,454 B2 9/2013 Schindler et al.
8,555,528 B2 10/2013 Gerber
8,555,529 B2 10/2013 Antonelli et al.
8,567,093 B2 10/2013 Sato
8,567,094 B2 10/2013 Lubart
8,567,096 B2 10/2013 Scholz
8,584,377 B2 11/2013 Blevens et al.
8,590,063 B2 11/2013 Aulenbach
8,590,175 B2 11/2013 Stockbridge et al.
D698,136 S 1/2014 Law et al.
8,621,765 B2 1/2014 Geer et al.
8,631,587 B2 1/2014 Aveni et al.
8,635,789 B2 1/2014 Spiller et al.
8,650,774 B2 2/2014 Aveni et al.
8,656,608 B2 2/2014 Goodwin et al.
8,661,717 B2 3/2014 Miner
8,677,652 B2 3/2014 Marvin et al.
8,677,653 B2 3/2014 Avar et al.
8,689,465 B2 4/2014 Aveni et al.
8,689,466 B2 4/2014 Aveni et al.
8,689,467 B2 4/2014 Miner
8,713,821 B2 5/2014 Nishiwaki et al.
8,720,084 B2 5/2014 Smaldone et al.
8,720,085 B2 5/2014 Smaldone et al.
8,726,424 B2 5/2014 Thomas et al.
8,726,541 B2 5/2014 Aveni et al.
8,732,986 B2 5/2014 Miner
D708,831 S 7/2014 Petrie
8,776,397 B2 7/2014 Borel et al.
8,789,253 B2 7/2014 Kilgore et al.
8,789,293 B2 7/2014 Greene
D710,582 S 8/2014 Chang
8,800,168 B1 8/2014 Propét
8,800,169 B2 8/2014 Howlett et al.
8,800,171 B1 8/2014 Khaitan et al.
8,813,387 B2 8/2014 Grove et al.
D712,127 S 9/2014 Hazzouri
D713,629 S 9/2014 Petrie
8,826,571 B2 9/2014 Rutherford
8,844,170 B2 9/2014 Ferrigan et al.
8,845,944 B2 9/2014 Sills et al.
D716,026 S 10/2014 Hazzouri
8,906,280 B2 12/2014 Maranan et al.
8,914,995 B2 12/2014 Andrews
8,914,997 B2 12/2014 Adami et al.
8,914,998 B2 12/2014 Gheorghian et al.
8,915,339 B2 12/2014 Kanous et al.
8,919,016 B2 12/2014 Mcdonald et al.
8,943,708 B2 2/2015 Spiller et al.
8,959,802 B2 2/2015 Hatfield et al.
8,961,618 B2 2/2015 Lecomte et al.
2003/0126770 A1 7/2003 Chen
2003/0150131 A1 8/2003 Mcmanus et al.
2004/0088883 A1 5/2004 Workman
2004/0181971 A1 9/2004 Turkbas et al.
2004/0194344 A1 10/2004 Tadin
2005/0166425 A1 8/2005 Seiter
2005/0274042 A1 12/2005 Issler
2006/0130365 A1 6/2006 Sokolowski et al.
2006/0283046 A1 12/2006 Mason
2007/0033834 A1 2/2007 Cheskin et al.
2007/0033835 A1 2/2007 Bray
2007/0094895 A1 5/2007 Kramer
2007/0107261 A1 5/2007 Cheskin et al.
2007/0209232 A1 9/2007 Chen
2007/0220779 A1 9/2007 Zona
2007/0234592 A1 10/2007 Crates
2007/0261274 A1 11/2007 Fox et al.
2008/0086909 A1 4/2008 Raspini
2008/0155858 A1 7/2008 Bray et al.
2008/0222918 A1 9/2008 Hesse
2008/0271340 A1 11/2008 Grisoni et al.
2009/0007455 A1 1/2009 Montgomery
2009/0025255 A1 1/2009 Fusco
2009/0031583 A1 2/2009 Avent et al.
2009/0049712 A1 2/2009 Steszyn et al.
2009/0071038 A1 3/2009 Luthi et al.
2009/0188129 A1 7/2009 Fusco
2009/0188131 A1 7/2009 Doerer et al.
2010/0005684 A1 1/2010 Nishiwaki et al.
2010/0146816 A1 6/2010 Cappaert et al.
2010/0146822 A1 6/2010 Macgregor
2010/0170107 A1 7/2010 Tzeng
2010/0180467 A1 7/2010 Singleton
2010/0205831 A1 8/2010 Cheskin et al.
2010/0212188 A1 8/2010 Granger et al.
2010/0269244 A1 10/2010 Nurse et al.
2010/0281709 A1 11/2010 Hwang
2011/0010964 A1 1/2011 Hardy et al.
2011/0192050 A1 8/2011 Hane
2011/0258882 A1 10/2011 Jones et al.
2012/0010730 A1 1/2012 Lecomte et al.
2012/0023776 A1 2/2012 Skaja et al.
2012/0025480 A1 2/2012 Kwok
2012/0227291 A1 9/2012 Rosenbaum
2012/0233885 A1 9/2012 Shaffer et al.
2012/0255199 A1 10/2012 Tzeng
2013/0031802 A1 2/2013 Park
2013/0031804 A1 2/2013 Abshire
2013/0031805 A1 2/2013 Crowley, II et al.
2013/0061495 A1 3/2013 Lubart
2013/0086733 A1 4/2013 Szalkowski et al.
2013/0118037 A1 5/2013 Bathum et al.
2013/0232819 A1 9/2013 Adair et al.
2013/0276329 A1 10/2013 James
2013/0291398 A1 11/2013 Cappaert et al.
2013/0298423 A1 11/2013 Daem
2014/0068965 A1 3/2014 Vattes et al.
2014/0250720 A1 9/2014 Miner et al.

MANUAL AND DYNAMIC SHOE COMFORTNESS ADJUSTMENT METHODS

CROSS-REFERENCE TO RELATED APPLICATION

This application is a divisional patent application of U.S. patent application Ser. No. 15/405,570, filed on Jan. 13, 2017 and entitled "MANUAL AND DYNAMIC SHOE COMFORTNESS ADJUSTMENT METHODS" which claims the benefit under 35 U.S.C. § 119 of the earlier filing date of U.S. Provisional Application Ser. No. 62/279,343 filed on Jan. 15, 2016, the entire contents of which are hereby incorporated by reference in their entirety for any purpose.

FIELD

The disclosed processes, methods, and systems are directed to modifying the comfort, fit, and performance characteristics of a shoe.

BACKGROUND

While shoes are often fashion statements, a well-designed shoe should protect the foot without causing discomfort. In general, the comfortability of a shoe is determined by the fit (for example the size) and the footbed. The footbed comprises an insole and an outer sole. The footbed being positioned below the foot to provide support and cushioning when the shoe contacts a walking surface (pavement, ground, etc.). The insole is designed to be in direct contact with the lower surface of the foot and the outer sole is designed to contact the walking surface (e.g. the ground). However, the footbeds of most shoes do not offer enough support for the foot, in general or the arch, ball, or heel of the foot, in particular. Additionally, some outsoles may not provide for enough traction with the ground.

Studies demonstrate that the positioning of a foot inside a shoe is a large determinant in the overall long-term health of the foot. Additionally, the angle at which a foot rests inside a shoe often determines the comfortability of a shoe for the wearer. This may be due to the angle at which a person's foot should rest inside a shoe differs from person to person.

As a result, there is need for shoes that contain footbeds that are adjustable. The present disclosure is designed to address that need.

SUMMARY

Disclosed herein are devices and methods for increasing the comfort of a shoe. In one embodiment the device comprises, a sole having a first and a second surface, two or more shocks, extending away from the first surface of the sole, the shocks defining a first end positioned at or near the first surface of the sole and a second end positioned away from the first surface of the sole, a shock cavity defined by two adjacent shocks and the first surface of the sole, wherein the two or more shocks define two or more shock angles, and the shock cavity defines a shock cavity angle, and wherein the sole is an insole that lies along a footbed of the shoe and designed to contact a user's foot, or the sole is an outsole positioned at a bottom of the shoe and makes contact with the walking surface. In some embodiments, the sole may further comprise a bumper material to allow the sole to be used within a series of shoes sizes, and the device may further comprise at least one displacement translator positioned within at least one cavity, and at least one support structure, wherein the displacement translator is substantially flat and connected to the support structure.

Also disclosed are methods of embedding additional shock absorption properties to a material, the method comprising the steps of creating a sole of a shoe comprising a first material having a first shock absorption property, altering the first shock absorption property of the sole through the creation of the individual shock cavities within the sole, and adding a shock cavity insert into an individual shock cavity and further altering the first shock absorption property, wherein the shock defines a first shock angle, and the shock cavity insert defines a first shock cavity angle, and a plurality of shock cavity inserts are added to the individual shock cavity, which are dissimilarly shaped. In some embodiments the shock cavity insert is made of a second material having a second shock absorption property, or the first material and the second material are the same, or the second material is made from a plurality of materials. In some embodiments, the first shock absorption property and the second shock absorption property are similar.

Also disclosed is a device to modify the shock impact absorption properties of an item worn on a foot, the device comprising, an insole having a first layer positioned above a second layer, the first layer having an upper surface and a lower surface, the second layer having an upper surface and a lower surface, an outsole positioned below the insole and having an upper surface and a lower surface, wherein a plurality of a first shock cavities are formed beneath openings in the lower surface of the second layer and between first shocks, the cavities extending towards the upper surface of the second layer, wherein the first shock defines a first shock angle, and the first shock cavity defining a first shock cavity angle, and, in some embodiments. further comprising a first shock cavity insert positioned within a portion of at least one of the first shock cavities, or a plurality of second shock cavities formed beneath openings in the upper surface of the surface of the second layer and between the second shocks, the cavities extending towards the lower surface of the second layer, which may further comprise a second shock cavity insert positioned within a portion of at least one of the second shock cavities. In some embodiments, the device further comprises a first leaf spring insert positioned adjacent to and beneath the lower surface of the second layer, wherein a portion of the first leaf spring insert extends into the first shock cavities, or the second leaf spring insert is positioned adjacent to and above the upper surface of the second layer, wherein a portion of the second leaf spring insert extends into the second shock cavities. In some embodiments, the device may further comprise a plurality of third shock cavities formed beneath openings in the lower surface of the outsole, the third shock cavities extending towards the upper surface of the outsole, or a plurality of fourth shock cavities formed beneath openings in the upper surface of the outsole, the fourth shock cavities extending towards the lower surface of the outsole.

DETAILED DESCRIPTION

Disclosed herein are devices, methods, and systems for increasing the comfortability of a shoe. In some embodiments, the shoes allow for customization of the shoe to conform to the wearers' wishes and needs.

Several problems are solved or reduced by the presently disclosed devices and methods. In some embodiments, the disclosed devices, methods, and systems allow for dynamic shock absorption. For example the disclosed methods and devices may aid in (1) reducing foot, knee, or pelvic/hip joint pain, (2) reducing pain at prostheses-limb contact surfaces, (3) adjusting leg length for people with unequal length legs, (4) allowing the user to feel as if they were walking on an air mattress or a gymnastics mat, (5) improving and adjusting foot support due to shock cavity and shock cavity inserts properties, (6) auto-ventilating the shoe and or foot to reduce foot and shoe odors as well as moisture buildup in the shoe, (7) reducing the abrasive friction of heel and shoe, (8) solving an age-old problem of the lack of high-displacement dynamic shock absorption insoles.

The present disclosure relates to an adjustable sole consisting of multiple shocks protruding away from the sole, creating a number of crevices in between the shocks known as shock cavities. Within these shock cavities, adjustable shock cavity inserts can be placed to control the comfortability and shock absorption.

Sole

Figure 1A:
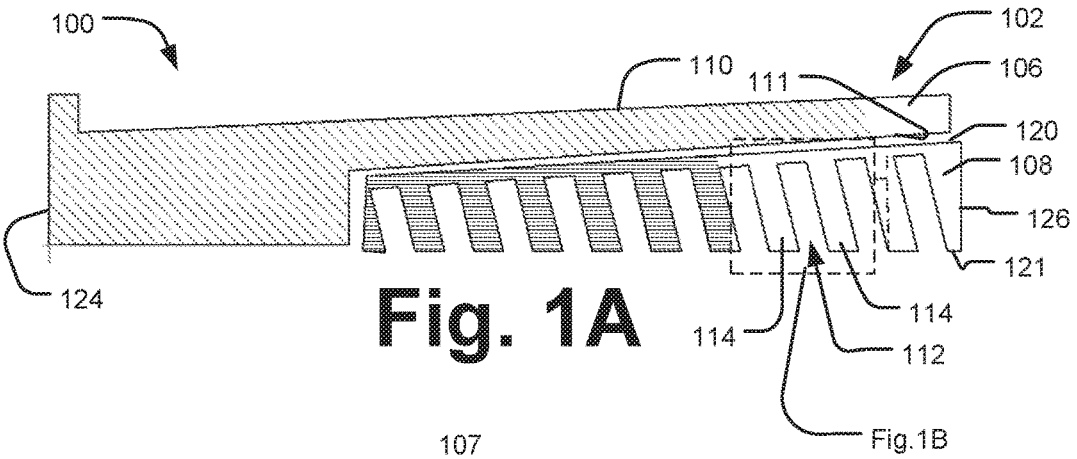
FIGS. 1A-1D are representative embodiments of an insole according to the present disclosure.
Figure 1B:
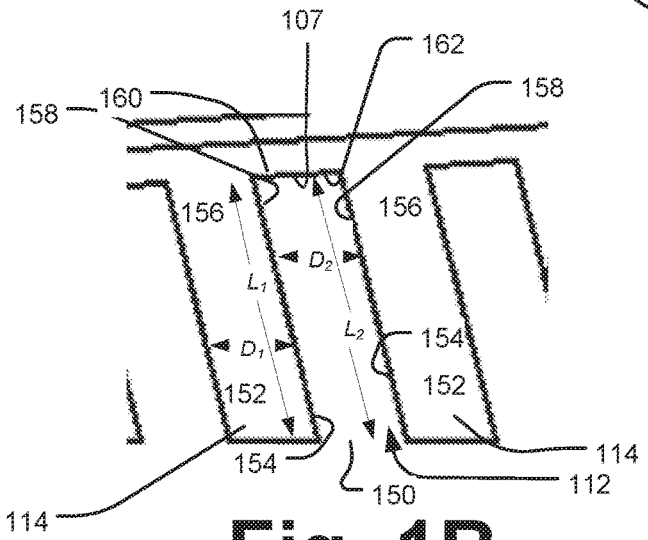
Figure 1C:
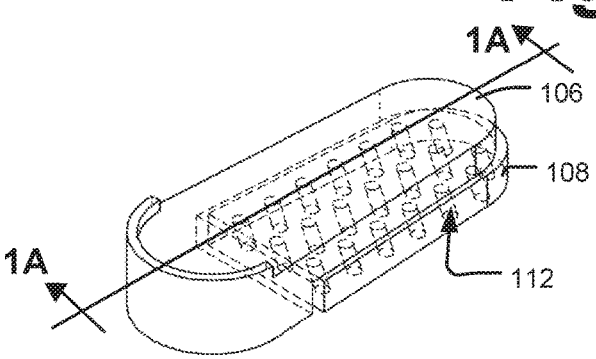
Figure 1D:
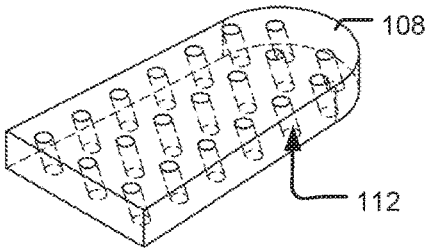

FIG. 1A is a view of an embodiment of an insole taken along line 1A-1A of FIG. 1C. The term sole 100 can refer to an insole 102 or an outsole 104 (see, e.g., FIG. 4A). A sole 100 may have one or more parts, for example, as depicted in FIGS. 1A, 1C, and 1D, an insole 102 may have a first, or top layer/part 106, and a second, bottom layer/part 108. In other examples, a cross-sectional view of the sole 100, such as an insole 102 or outsole 104, may have another configuration, such as those described in FIGS. 9A and 9B. The top part 106 of the insole 102 may define a top surface 110 for contacting and/or supporting a foot, the bottom surface 111 of the first part 106 for contacting the second, bottom part 108. The bottom part 108 may define a top surface 120 for contacting and/or supporting the first part 106 of the insole 102, and a bottom surface 121 for contacting a shoe. The sole 100 includes a toe end 124 and a heel end 126. The toe end 124 is designed to be located at or near the toes of the foot, and the heel end 126 designed to be located at or near the heel end of the foot. In various embodiments, the sole 100 may be about the length of the foot and/or shoe. In some embodiments, the sole 100 may be about half the length of the foot or shoe. The sole 100 may define a plurality of shock cavities 112 that are formed between shocks 114 formed in the sole 100. FIG. 1B is an expanded view of a portion of the shock cavities 112 and shocks 114 of FIG. 1A Shock cavities 112 may be defined in a top surface 110, 120 (see FIG. 9A) of the sole or the bottom surface 111, 121 (see FIG. 9B) of the sole. The shock cavities 112 may form an orderly or random grid with various spacing and patterns, as shown in FIGS. 4B-6A. In some embodiments, the toe end 124 of the sole 100 may have more shock cavities 112 than the heel end 126 and vice-versa, as shown in FIG. 6.

Figure 10:
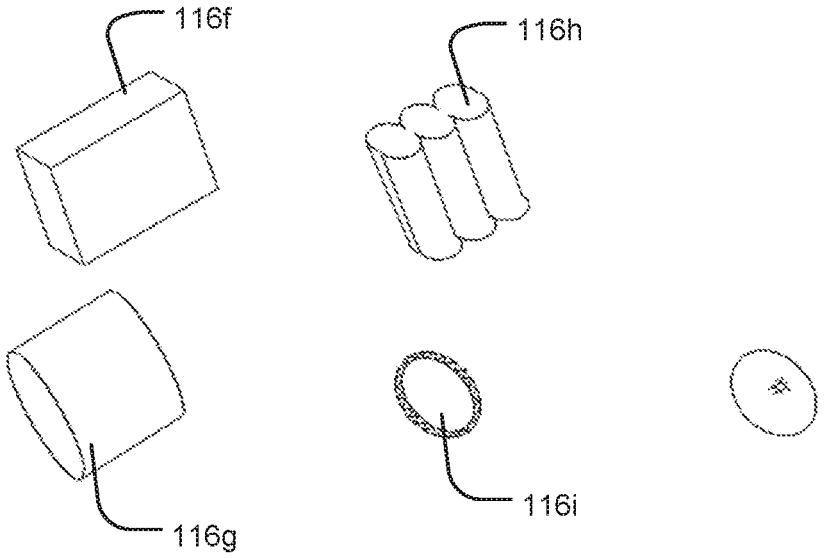
FIG. 10 shows various representative embodiments of the shock cavity inserts.

One embodiment of an insole 102 is depicted in FIG. 1A. FIG. 1A depicts a two-part insole having a first layer 106 and a second layer 108 wherein layer 106 is a first, top part designed to contact a foot on the upper surface 110. Layer 106 may absorb the impact of shock forces generated by the user, but does not have shock cavities and thus may have limited shock absorption properties. The second layer 108 is a lower part and defines a shock layer with a plurality of shock cavities 112 and shocks 114. FIG. 10 is a perspective view of a second layer. The shock cavities 112 and shocks 114 of layer 108 may be designed for accepting the impact of shock forces generated by the user. Shocks 114 and shock cavities 112 are discussed further below and in relation to FIGS. 2A-2B.

Shock

Figure 2A:
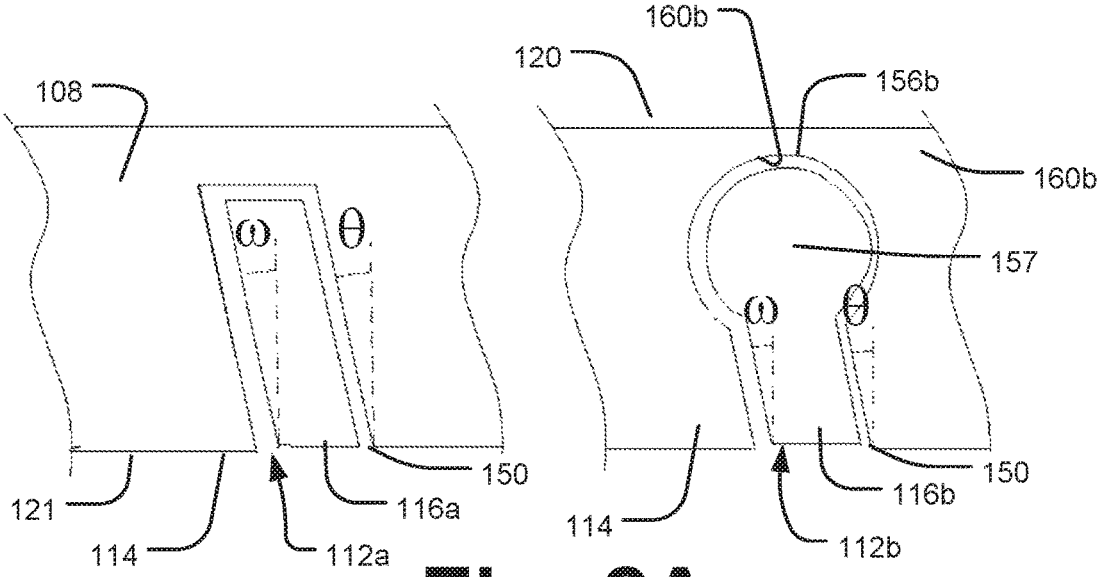
FIGS. 2A-2B are representative embodiments of shock cavity inserts according to the present disclosure.

Shocks 114 may aid in providing support for the sole 100 of a shoe, as well as providing for the creation of shock cavities 112 to adjust the shock force absorption of the sole 100 and the shoe and other material properties. Shock cavity inserts 116*a*, 116*b* may be positioned within a shock cavity 112, as shown in FIG. 2A. In other examples, the shocks may have a different configuration, such as those described in FIGS. 1A, 3A, 7B, 8, 9A, 9B, 11A, 12A-12C, 14A-14B, 15A, 15B, 17A, 16A-16C, 18A, 19A, 20A, and 21A. A shock 114 may be defined by the structure between adjacent shock cavities 112, which may or may not be designed to accept a shock cavity insert 116. Shocks 114 may extend from a surface 107 of the sole 100 at an angle Θ measured from vertical, away from the plane of the surface. The value of angle Θ may vary for different embodiments, similar embodiments using different materials, similar embodiments using different insole sizes, and to meet certain user comfort requirements. In many embodiments, the value of angle Θ may vary from 0 to 45 degrees, and in preferred embodiments may vary from 5 to 45 degrees.

Figure 7A:
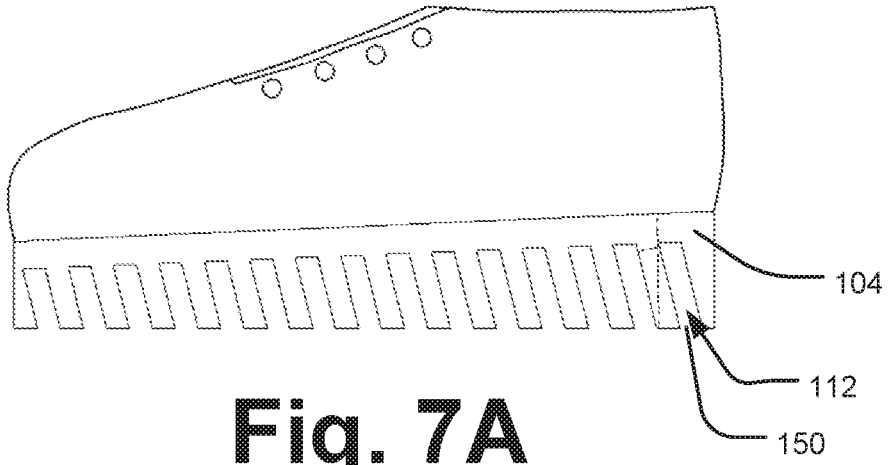
FIGS. 7A-7C are representative embodiments of the outsole shock cavities.
Figure 7B:
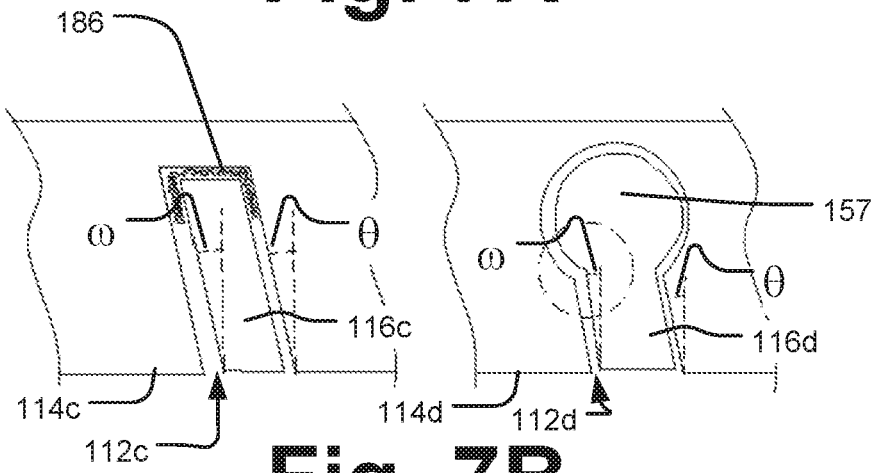

One embodiment of a shock 114 is depicted in FIG. 1A. FIG. 1A depicts the shock cavities 112 defined in second layer 108 of an insole 102. The shock cavities 112 of layer 108 extend away from the first layer 106 at an angle θ measured from vertical. The shock 114 and shock cavity 112 may embody various characteristics, for example length, width, stiffness, compressibility, value of angle θ, etc. FIG. 7B further depicts the angle θ of the shock cavity 112 and shock 114 measured from vertical and the angle ω of the shock cavity insert 116 (see below). In many embodiments, the angle θ of the shock cavity 112 and shock 114 and the angle ω of the shock insert 116 may be equal. In other embodiments, the value of angle θ of a shock cavity 112 and shock 114, at a particular location, may be different at another location, such that the angle θ varies at different locations of the sole 100. In some embodiments, the characteristics of a shock cavity 112 may be dependent on the sizes or walls of the shock 114 that define the shock cavity 112 as well as the spatial arrangement of shock cavities 112. The various characteristics of a sole 100 may differ, and in some cases may be adjusted, to allow for greater user discretion in choosing the overall character of the shoe. For example, various combinations of characteristics may allow the user to select an insole 102 or outsole 104 for its comfort and/or its performance characteristics. The ability to select these combinations may lead to enhanced comfortability of a shoe.

The shock may be comprised of various parts. As depicted in FIG. 1B, the shock may have an upper part/portion 152, positioned at or near a shock cavity opening 150. The shock may have a lower portion 156, positioned distal to the opening 150. The shock may define a surface 154 at the upper portion 152, and a second surface 158 at the lower portion 156. The shock may also define a width, D1, measured from one surface in one cavity 112 to a similarly positioned surface in an adjacent cavity. The shock may also define a depth, L1, measured from the surface 111 of the sole at or near the opening 150, to the base 160 formed by the surface 107. In some embodiments, as shown in FIGS. 1A and 1B, the depth, L1, may change when measured near one surface in one cavity and then the adjacent cavity. In other embodiments, the depth is constant. In some embodiments, the shock may be removable.

Shock Cavity

The property of a shock cavity 112 may depend on orientation (angle), dimensions shape, grid pattern (e.g. distance between adjacent shock cavities 112, number of cavities 112 per unit of area), and properties of the material between the shock cavities 112 (e.g., shock 114 material). These properties—such as density, elasticity, and rebound—as well as shock cavity insert 116 dimensions may help to control feel, displacement (horizontal and height) and shock force absorption.

Referring again to FIG. 1B, which depicts a shock cavity from FIG. 1A. In this embodiment, the shape of the shock 114 may help define the shape of the shock cavity 112. The shock cavity 112 may be defined by the opening 150 in the sole, here an outsole 104, and two adjacent shocks 114. The shock surfaces 154, 158, and a lower surface 162, positioned at or near the lower portion 156 of the shock help to define a shock cavity volume. The shock cavity may also define a width, $D_2$, measured from one surface (e.g. 158) to a similarly positioned surface on the other side of the cavity. The shock cavity may also define a depth, $L_2$, measured from the opening 150, to the base surface 162. In some embodiments, as shown in FIGS. 1A and 1B, the depth, $L_2$, may vary, for example from one end of the cavity and the other (see also FIG. 2A). In other embodiments, the depth is constant. In some embodiments, wherein the cavity is cylindrical, the width, $D_2$, may be a diameter, which in some embodiments may differ from the upper portion to the lower portion (again, see FIG. 2A).

Figure 11A:
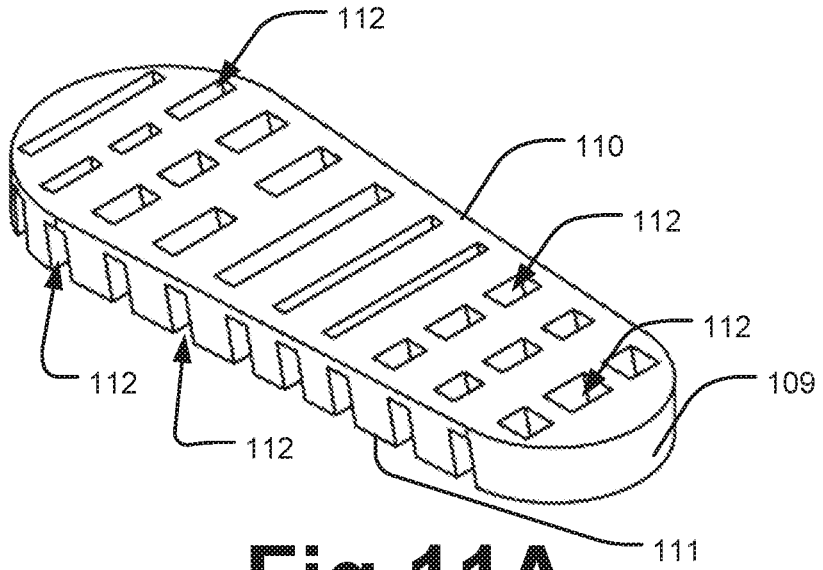
FIGS. 11A-11C are representative embodiments of shock cavities on both sides of a sole (insole or outsole).
Figure 11B:
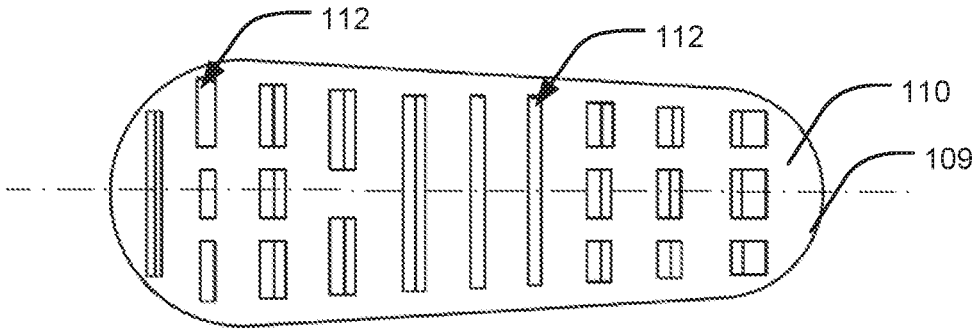
Figure 11C:
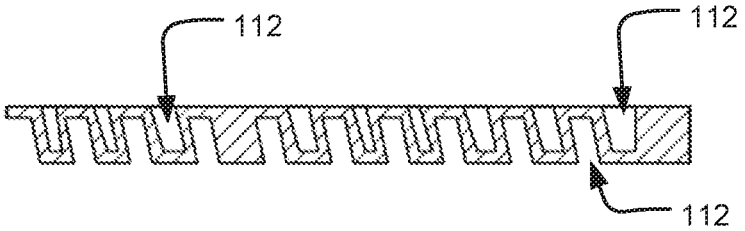

In some embodiments, the shock cavity 112 defines a cylindrical shape. In other embodiments, the shock cavity 112 defines various other shapes. In some embodiments, as shown in FIGS. 11A-11C, the shock cavity 112 defines a shape that is other than cylindrical. In these embodiments, the shock cavity may be rectangular or trough-like.

FIGS. 11A-11C further depict an embodiment of the disclosed sole 100, for example an insole 109, with shock cavities 112 defined in the upper surface 110 and the lower surface 111 of the first layer 106 of the insole 102. In this embodiment, the lower surface 111 defines a plurality of shock cavities 112 extending toward the upper surface 110 of the insole 109, while the upper surface 110 of the insole 109 defines a plurality of shock cavities 112 that extend toward the lower surface 111. In these embodiments, the shock cavities 112 of one surface may extend into the shocks 114 of the other surface. In other embodiments, the shock cavities 112 of one surface do not extend into the shocks 114 of the other surface.

The shock cavity 112 may be designed to accept a shock cavity insert 116. In many embodiments, the shock cavity 112 insert 116 may define a shape that may aid in retaining a shock cavity insert within the shock cavity. One embodiment of a shock cavity 112 for retaining a shock cavity insert 116 is depicted in FIG. 2A with the second layer 108 of an insole 102. In FIG. 2A, the shocks 114, shock cavities 112, and the shock cavity inserts 116 are formed in the lower surface 121 of layer 108.

Referring to the shock cavity 112 embodiment of FIG. 2A, the width of the base 160*b* between the shocks 114 maybe wider than the opening 150 to aid in retaining a shock cavity insert 116 within the shock cavity 112.

Shock Cavity Insert

Figure 2B:
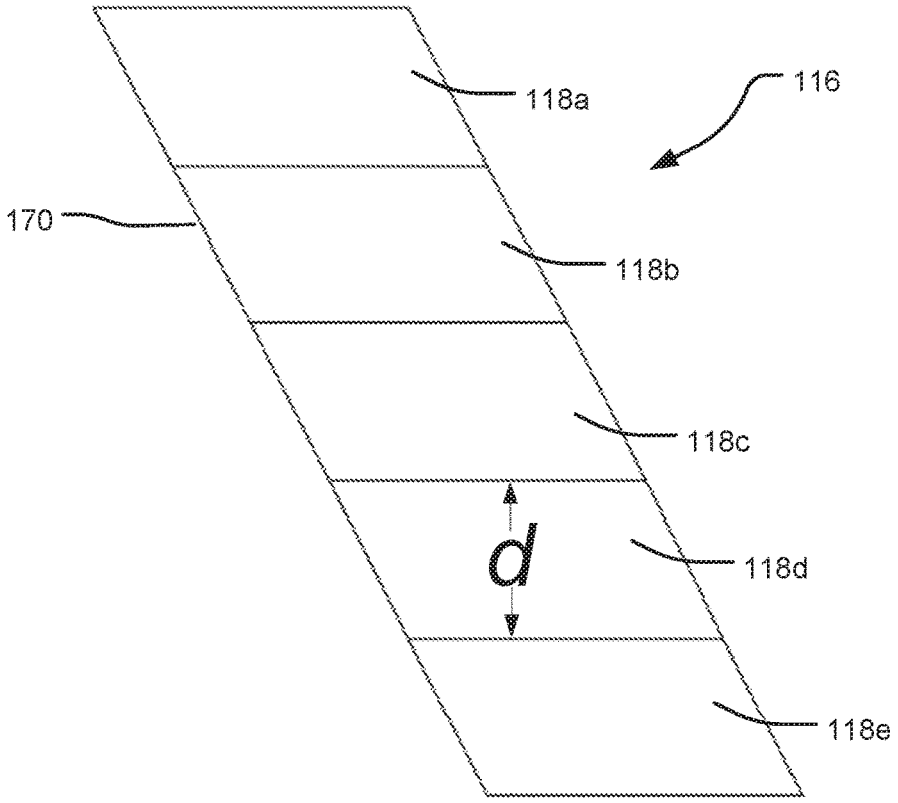

Shock cavity inserts 116 may be designed to occupy a volume of the shock cavity 112 defined by the surrounding shocks 114. With reference to FIG. 2B, in some embodiments, the shock cavity insert 116 may define an outer surface 170 that is in contact with or adjacent to the upper surface 154, lower surface 158, and base surface 162 that form the shock cavity 112. In some embodiments, the shock cavity insert 116 may not occupy all of the volume of the shock cavity 112—in these embodiments there may be a distance between the surface of the shock cavity insert 170 and the surfaces that form the shock cavity 112. In some embodiments, the surface 170 of the shock cavity insert 116 may contact the surfaces 154, 158, 160 that form the shock cavity 112 at some positions but not others. In some embodiments, multiple shock cavity inserts 116 may be inserted into one shock cavity 112, which may result in increasing the overall density of the combined shock cavity inserts 116. This may make the effective insert less compressible, and therefore increase the firmness of the shock cavity insert 116.

In many embodiments, the dimensions of the shock cavity insert may be similar to the dimensions, $D_2$ and $L_2$, of the shock cavity. In other embodiments, the shock cavity insert's dimensions may be a percentage of the corresponding dimensions of the shock cavity. For example the dimensions of the shock cavity insert may be from about 80%-105% of the corresponding dimensions of the shock cavity in any one or more positions. In some embodiments, the dimensions may be uniformly different, and in other embodiments, one dimension may be one value and a second dimension may be another—for example the depth may be about 90% while the width is 101%. In many embodiments, the dimensions of the shock cavity insert may be greater than about 80%, 85%, 90%, 91%, 92%, 93%, 94%, 95%, 96%, 97%, 98%, 99%, 100%, 101%, 102%, 103%, or 104%, and less than about 105%, 104%, 103%, 102%, 101%, 100%, 99%, 98%, 97%, 96%, 95%, 9.4%, 93%, 92%, 91%, 90%, or 85% that of the corresponding dimension of the shock cavity. In some embodiments, for example embodiments where a shock insert is compressible, such as where the insert is made of a compressible foam material, the shock insert may define a volume, when uncompressed, that is greater than 100% the volume of the cavity. For example, in these embodiments, the difference may be greater than 105%, 110%, 120%, 130%, 140%, 150%, 160%, 170%, 180%, 190%, 200%, or 300%, and less than about 350%, 300%, 250%, 200%, 190%, 180%, 170%, 160%, 150%, 140%, 130%, 120%, or 110%. In some embodiments, for example wherein the density of the insert's material is the same or similar to the sole material's density, the volume difference may be from about 80% to about 120%. In embodiments wherein the insert is made of a silicone or a gel material, the volume of the shock insert may be about 95% to about 105% of the shock cavity's volume.

The shock cavity insert 116 may define various shapes, which may correspond to the shapes defined by the shock cavity 112. While many embodiments of shock cavity insert 116 may be cylindrical to correspond to a cylindrical shock cavity shape, such as shock cavity insert 116*g* of FIG. 10, other embodiments may be shapes other than cylindrical. FIG. 10 shows shock cavity insert embodiments that are oblong and rectangular, such as 116E FIG. 10 also shows a concatenated shock cavity insert 116*h* with oblong subunits, wherein the oblong subunits are stacked atop each other to form a shock cavity insert 116*h*.

Shock cavity inserts 116 may be comprised of various materials. In some embodiments, the shock cavity insert 116 may be hollow, such as the cross-sectional view of 116*i* of FIG. 10 or may define an interior material that is different than the exterior material of the shock cavity insert. In some embodiments, the interior of the shock cavity insert 116 is solid, liquid, or gas. The selection of the material or materials of the shock cavity insert 116 may aid in changing the performance characteristics of the shock cavity insert 116. In some embodiments, the material may be selected from ethylene-vinyl acetate (EVA), rubber, silicone, gel, or any material having sufficient shock absorbing properties.

Shock cavity inserts may also define an angle similar to θ. In many embodiments, this angle, ω, may correspond to the angle θ for the cavity where a specific shock cavity insert resides. In many embodiments, such as the embodiment of FIG. 2A, where the shock cavity insert has a non-uniform structure, may be defined by the angle of the insert at or near the opening 150 of the shock cavity. As described above, in many embodiments, angle ω may be the same or similar to angle θ. That is in most embodiments, angle ω is about 0 degrees to about 45 degrees, and in preferred embodiments is between about 5 degrees and about 45 degrees.

Referring to FIG. 7B, the angle θ of the shock cavity 112 may aid in redirecting the directional forces associated with an impact. During the process of compression, as the foot presses on the sole 100, the angle θ, together with the shock 114 and shock cavity insert 116 may help the shock cavity 112 gracefully collapse. In many embodiments, compression changes the angle θ position. In the case of an insole 102, the angle θ is selected so that compression and collapse of the shock cavity 112 may help to redirect the foot away from the heal end 126 of a shoe, reducing contact of the heel of the foot with the shoe, as shown in FIG. 17B. The angle θ may be dependent on properties of sole materials, physical structure of the shock cavities 112, and relative spacing between adjacent shock cavities 112 formed by the shocks 114, and shoe size, which may be an indicator of the user's weight. In addition, it is possible to improve shock impact absorption performance and feel by adding multiple distinct angle θ values to a given sole 100. This may be desirable for having different shock absorption properties as deformation spreads from the center of impact.

Referring to FIG. 2B, shock cavity inserts 116 may comprise one or more subunits 118. The subunits 118 may be designed to fit together, and may aid in customizing the performance of the shock cavity insert 116. In some embodiments, two or more shock cavity inserts 116 may be made of the same or different materials. In some embodiments, the subunits 118 of a single shock cavity insert 116 may be of the same or different materials. The material or materials from which a shock cavity insert 116 is made may aid in modifying the performance of the shock cavity insert 116 and the insole 102. FIG. 2B shows a shock cavity insert with multiple subunits, 118*a*, 118*b*, 118*c*, 118*d*, 118*e*, demonstrating the adjustability of the composition of a shock cavity insert 116. In this embodiment, the length of the shock cavity insert 116 may be varied by varying the number and depth, d, of the individual subunits.

FIG. 2A shows an example bottom layer 108 of an insole 102 with shock cavities 112 and shock cavity insert 116 embodiments, as well as the shock cavity at angle θ. The embodiment on the left of FIG. 2A shows a shock cavity insert 116*a* and a shock cavity 112*a* without a visible means of retaining the shock cavity insert 116*a* within the shock cavity 112*a*. The embodiment on the right of FIG. 2A has a lower portion 156*b* of the shock cavity 112*b*, adjacent to the base 160*b*, defining a structure 157 to aid in retaining the shock cavity insert 116*b* in the shock cavity 112*b* with a similar, complementary structure. In addition to the shock cavity insert 116*b* complementary structure, the shock cavity 112*b* embodiment of FIG. 2A also depicts a retaining feature 157 of the shock cavity insert 116*b*. Many different forms of retaining features for shock cavity inserts 116 within a shock cavity 112 are contemplated. For example, shock cavities may be snapped, screwed, or pressed into the shock cavity via a screw lock, snap lock, or pressure lock.

Figure 3A:
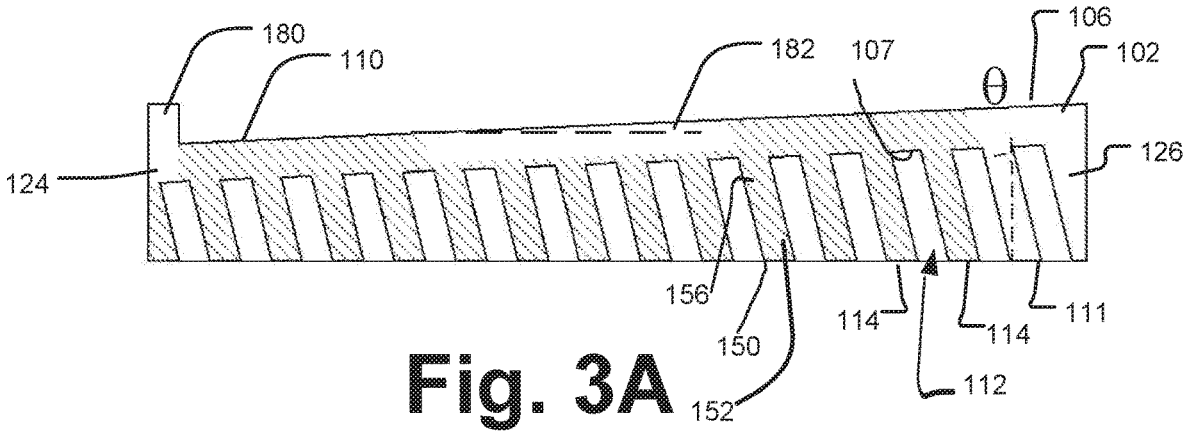
FIGS. 3A-3B are additional representative embodiments of an insole according to the present disclosure.
Figure 3B:
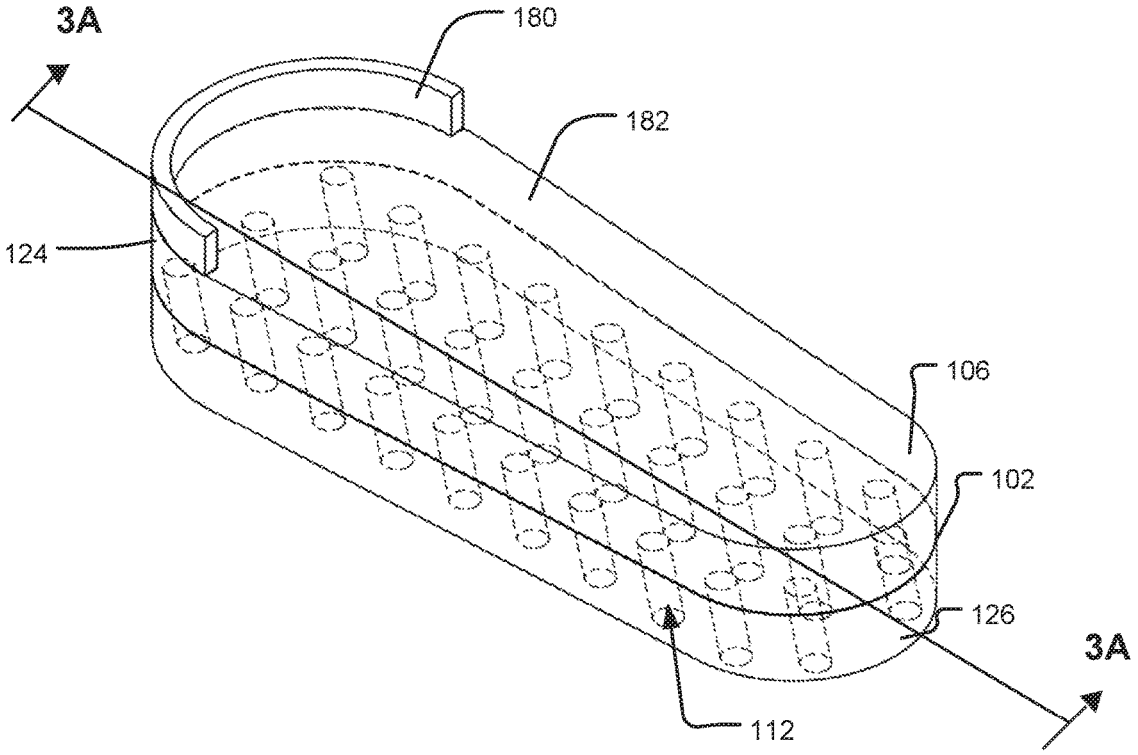

FIG. 3B is a perspective view of the embodiment in FIG. 3A. In this view, the interior of the insole 102 is visible and the shock cavities 112 are cylindrical.

FIG. 3A is a sectional view along line 3A-3A of FIG. 3B and depicts an embodiment of a first layer 106 of an insole 102 with a toe shock 180. The toe shock 180 may extend upward from the top surface 110 of the first layer 106 of the insole 102. In this embodiment, the toe shock 180 is positioned at an edge at or near the toe end 124. The edge of the insole 102 at the toe end 124 of this embodiment is curvilinear, and may be designed to correspond to the curvilinear shape or structure of a shoe. This embodiment further defines that the top surface 110 has a slope 182, such that the toe end 124 of the sole is closer to the ground (and may be thinner) than the heel end 126, which may be thicker. This embodiment has only one part, wherein the top surface is designed to contact and support a foot, and the bottom surface defines a plurality of shock cavities 112. This configuration may also be used with an outsole 104 or a second layer 108. In other examples, a cross-sectional view of the sole 100, such as an insole 102 or outsole 104, may have another configuration, such as those described in FIGS. 11C, 15A, and 17A.

Figure 4A:
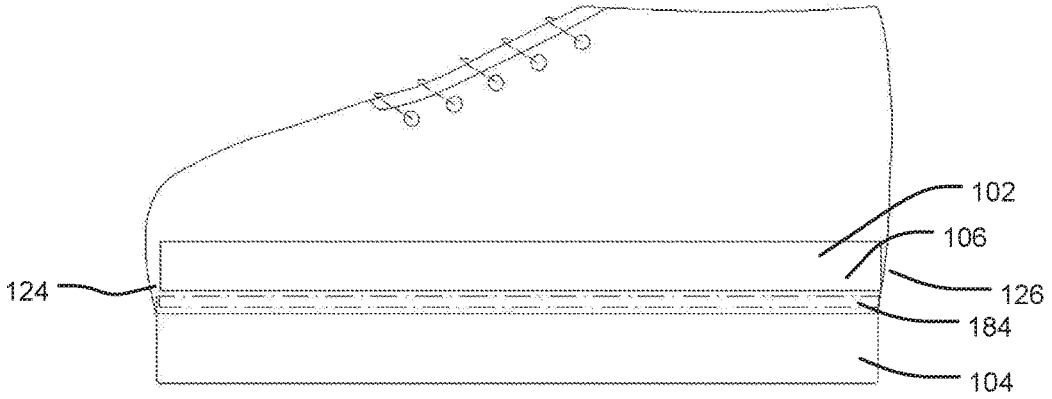
FIG. 4A is an additional representative embodiment of an insole.
Figure 4B:
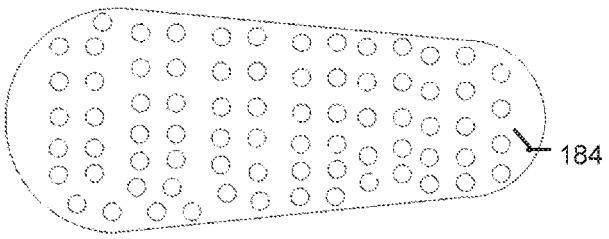
FIG. 4B is a shock cavity grid patterns on the outsole or insole.

FIGS. 4A-4B show an embodiment of the insole 102 positioned atop a sole stiffener 184. As depicted in FIG. 4A, a side cross-sectional view of the shoe, with the insole 102 and sole stiffener 184. The sole stiffener 184 may rest on the shoe foot bed, or outsole 104. In other examples, the sole 100, such as an insole 102, or outsole 104, may have a different configuration, such as those described in FIGS. 8, 18A, 19A, 20A, and 21A. In this embodiment, the sole stiffener 184 is positioned between the insole and the top surface of the shoe foot bed or outsole 104. The stiffener 184 may also aid in supporting or cushioning the insole 102. In some embodiments, as depicted in FIG. 4B, the stiffener 184 may be perforated, for example with one or more holes. In some embodiments the stiffener 184 may be stiff or rigid, or may be flexible and pliant. The holes of the stiffener may aid in enhancing shock impact absorption qualities of the shoe containing such a sole stiffener 184.

Figure 5A:
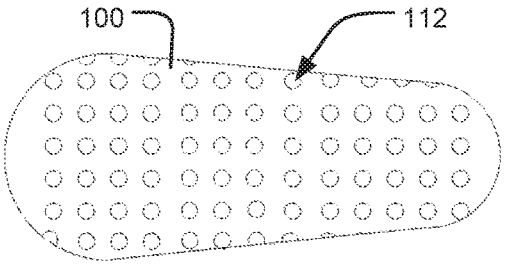
FIGS. 5A and 5B are representative embodiments of the shock cavity grid patterns on the outsole or insole.
Figure 5B:
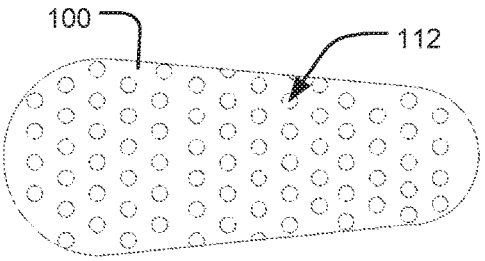
Figure 6:
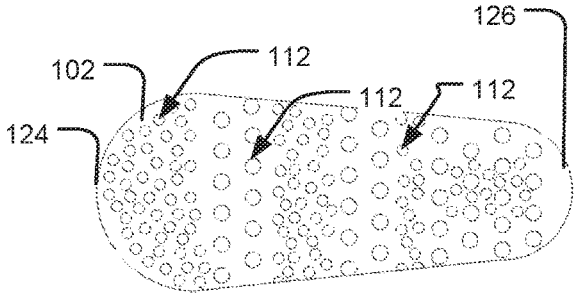
FIG. 6 is a representative embodiment of a clustering shock cavity grid pattern on the outsole or insole.

FIGS. 5A-5B show embodiments of the sole 100 wherein the shock cavities 112 may be arranged in a square (FIG. 5A) or an alternating (FIG. 5B) pattern. In many embodiments, the shock cavities 112 spacing or density may be substantially constant (FIGS. 5A and 5B). In some embodiments, the spacing or density of the shock cavities 112 may vary on the surface of the insole 102 or the outsole 104. For example, in some embodiments, the shock cavity 112 density may be increased at a position (for example near the heel) to aid in enhancing comfortability. FIG. 6 shows such an embodiment, wherein the density of shock cavities 112 is higher near the heel end 126 and the toe end 124.

Figure 7C:
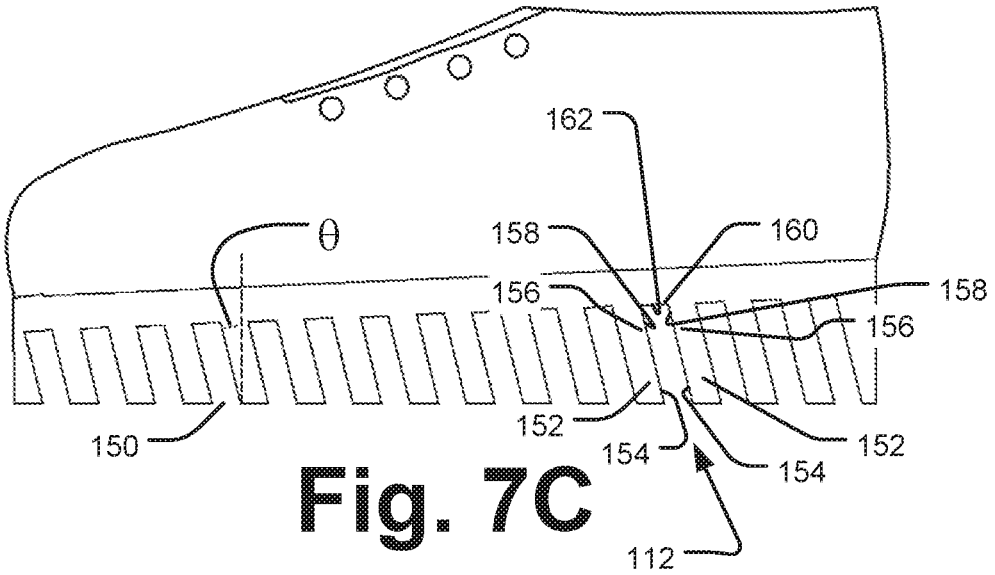

FIG. 7C shows an embodiment of a shoe having an integral sole 100 or outsole 104 comprising shock cavities 112. In this embodiment, the shoe has an outer sole 104 that may define a plurality of shock cavities 112 positioned with the opening 150 of each shock cavity 112 at or near the ground.

FIG. 7B shows various embodiments of shock cavities 112*c*, 112*d* and shock cavity inserts 116*c*, 116*d* in cross-sectional view. In these embodiments the shock cavity insert is held in place by either a structure 157 having corresponding complementary features in both the cavity 112*d* and the shock cavity insert 116*d* or the shock cavity insert 116*c* is retained in the shock cavity 112*c* with an adhesion or connection apparatus 186, such as glue. As described above, securing a shock cavity insert 116 within a shock cavity 112 may be through an adhesion or connection apparatus 186 such as a snap lock, glue, pressure lock, or screw lock.

Figure 8:
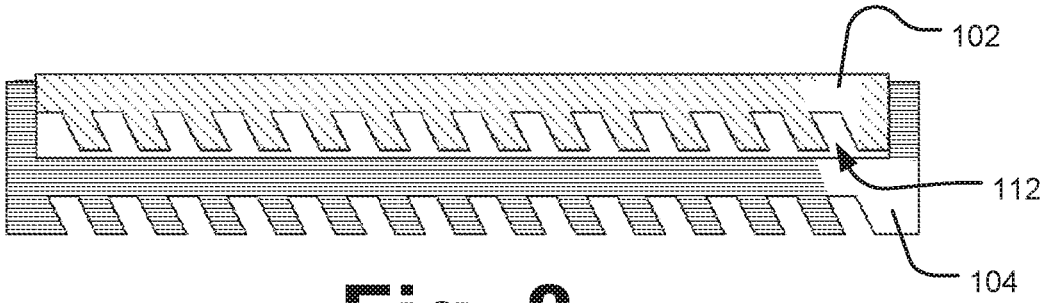
FIG. 8 is a representative embodiment of shock cavities on the insole and outsole of an embodiment.

FIG. 8 shows an embodiment of the disclosed shock cavities 112 and shocks in an outsole 104 having shock cavities 112 and an insole 102 with shock cavities 112. Shock cavity inserts are not depicted in this embodiment. In some examples, the embodiment may be used in a sandal.

FIG. 10 shows additional embodiments of contemplated shock cavity insert structures 116*a*, 116*b*, 116*c*, 116*d*.

Figure 9A:
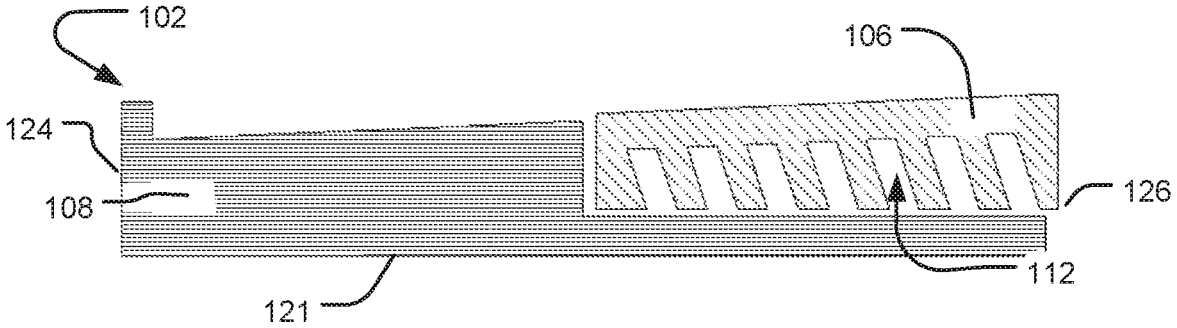
FIGS. 9A-9B are representative embodiments of an insole according to the present disclosure.

FIG. 9A shows an embodiment of the disclosed device having two parts. In this embodiment, the insole 102 comprises the second layer 108 with a lower surface 121 for contacting a support sole, ground, or footbed, and a first layer 106 designed to be supported by the second layer 108. In this embodiment, the first layer 106 is also designed, at least in part, to support a foot. The first layer 106 of the embodiment of FIG. 9A may be designed to support the back portion of the foot, while the front of the foot is supported by the second layer 108. In other embodiments, such as that of FIG. 9B, the second layer 108 may be designed to support the entire foot or a different proportion of the foot than the embodiment in FIG. 9A. The embodiment of FIG. 9A also depicts a the second layer 108 comprising a toe stop 180 structure positioned at or near the front, toe end 124 of the insole 102, while in other embodiments, a toe stop may be positioned on the feature labeled on the first layer 106. In some embodiments, as described above, there is not a toe stop The embodiments of FIGS. 9A-9B may also be used with an outsole 104 configuration.

Figure 9B:
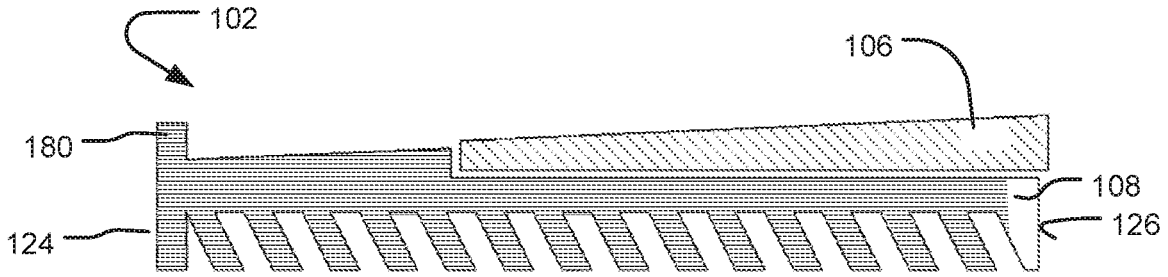

The embodiments of FIGS. 9A-9B depict an insole 102 that is thicker at the heel end 126 than at the toe end 124. This embodiment may aid in elevating the heel of the wearer. In some embodiments the second layer 108 may be substantially flat or planar, and the first layer 106 may be added to increase the thickness of the insole 102 at or near the heel end 126. In other embodiments, first layer 106 may be added to add thickness to other portions of the sole 100 or insole 102, for example the toe, arch, ball of the foot, and/or heel. In some embodiments, the first layer 106 or second layer 108 define a uniform thickness that defines a planar or substantially flat upper surface for supporting the foot. As described above, compression may change the thickness of the first and/or second subunits in various ways.

There are two embodiments of the presently claimed sole shown in FIGS. 9A and 9B. The embodiment of FIG. 9A has a plurality of shock cavities positioned in the first layer 106, with no shock cavities defined by the second layer 108. The embodiment of FIG. 9B has shock cavities 112 defined by within the second layer 108, but not in the first layer 106. In some further embodiments, both the first layer 106 and the second layer 108 may have shock cavities 112.

Leaf-Spring Shocks

Figure 12A:
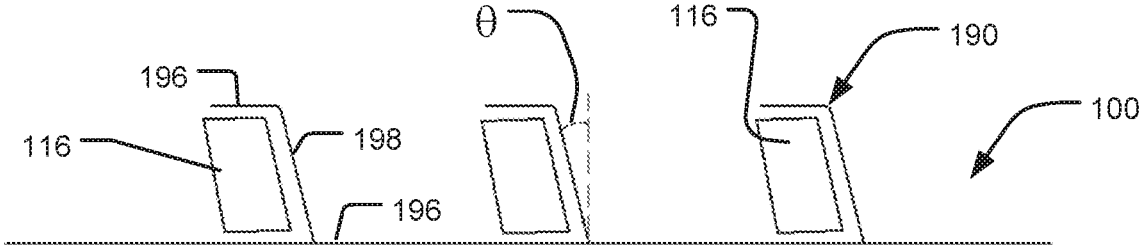
FIGS. 12A-12C are representative embodiments of different shock cavities formed with leaf springs.
Figure 12B:
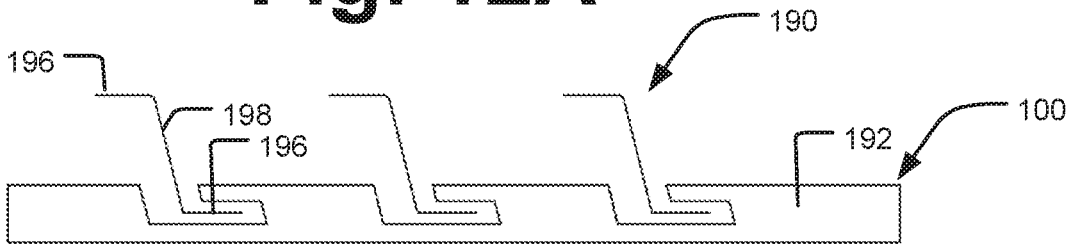
Figure 12C:
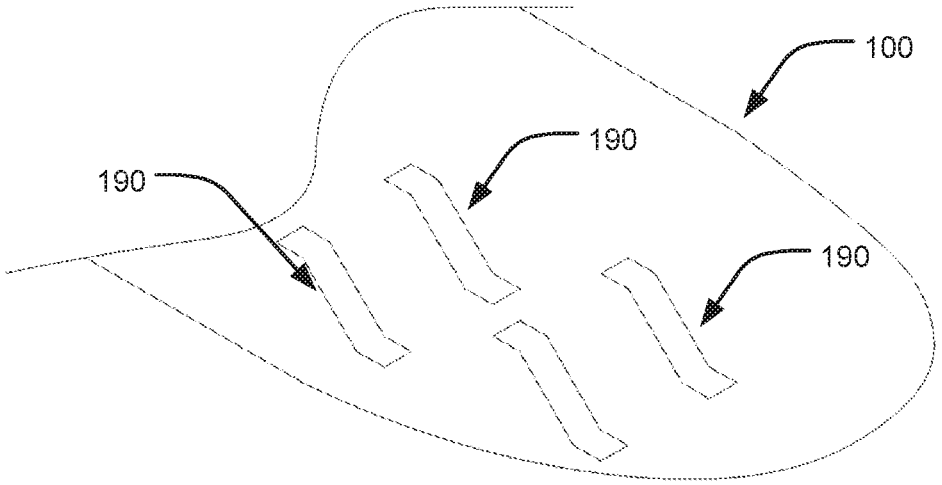

In some embodiments, the shocks 114 may define a leaf-spring structure, as depicted in FIGS. 12A-12C. In these embodiments, the leaf spring 190 may be an integral part of the sole 100 as shown in FIG. 12A or may be inserted into leaf spring acceptor structures 192 defined within the surface of the sole 100 as shown in FIG. 12B and the leaf springs 190 may be removable. In some embodiments, shock cavity inserts 116 may be positioned near the leaf spring 190 so that when the leaf spring 190 is compressed toward the surface of the sole 100, it may contact the shock cavity insert 116, as shown in FIG. 12A. In many cases, the shock cavity inserts used in conjunction with the leaf springs 190 may be similar to the shock cavity inserts 116 described above. The embodiments of FIGS. 12A-12C show leaf springs 190 that may be oriented in the same direction; in FIGS. 14A and 14B, the leaf springs 190 may be bowl shaped, and a connector 194 may be used to connect or couple the leaf spring 190 with a portion of the sole 100.

The leaf spring shock embodiments depicted in FIGS. 12A-12C each have three sections: two parallel sections 196 that may be substantially parallel to each other and the surface of the sole 100, with a third, non-parallel section 198 positioned between and connecting the two parallel sections 196. As shown in FIG. 12A, in many embodiments, the third connecting section 198 may define an angle e that displaces the second parallel section 196 from first parallel section 196. The first parallel section 196 or second parallel section 196 may be inserted in, connected to, or attached to the surface of the sole 100 using a connector 194 or a leaf spring acceptor structure 192.

Figure 14A:
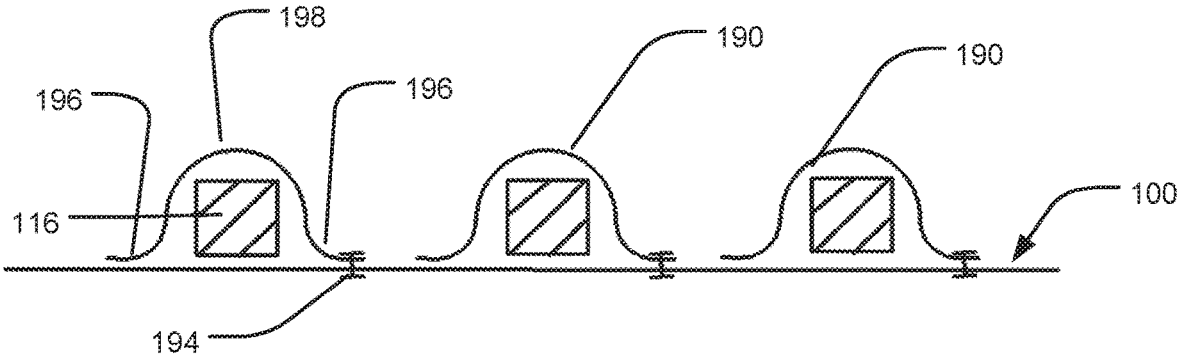
FIGS. 14A-14B are representative embodiments of bowl shape shocks.
Figure 14B:
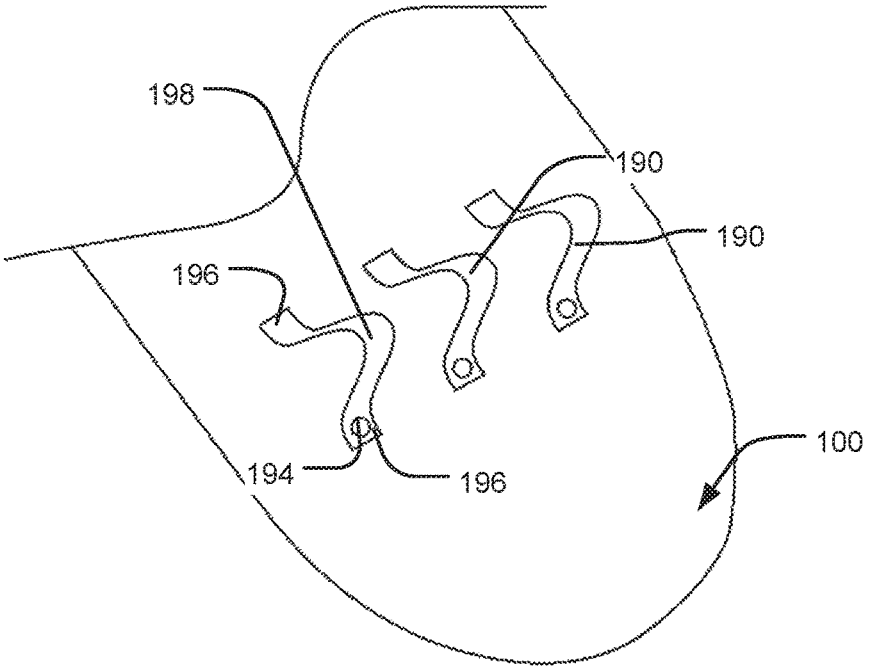

FIGS. 14A-14B depicts embodiments of the disclosed leaf spring 190 wherein the leaf spring 190 is curvilinear. In this embodiment, the leaf spring 190 may comprise two planar sections 196 that contact the surface of the sole that are connected by a third, non-planar section 198.

Displacement Translator

Figure 15A:
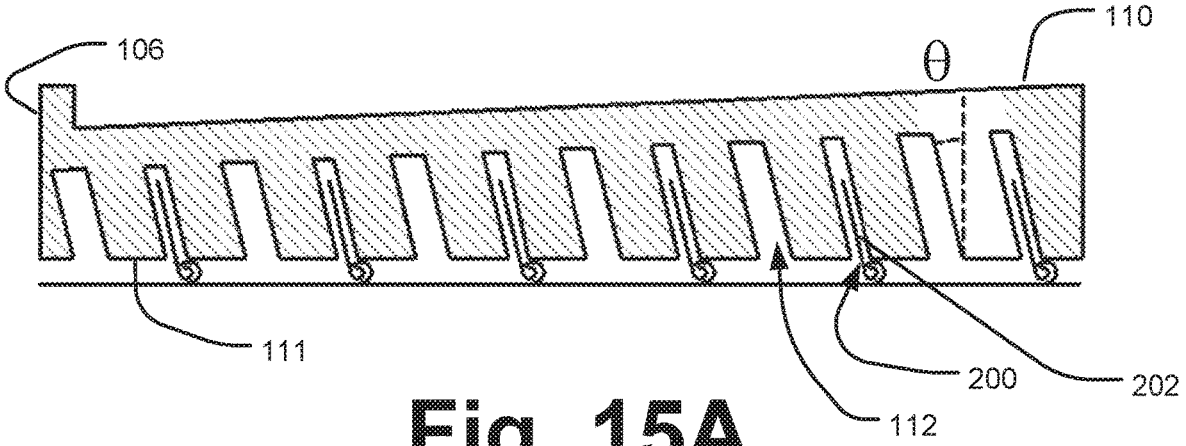
FIGS. 15A-15B are representative embodiments of the present disclosure showing secondary displacement translator systems.
Figure 15B:
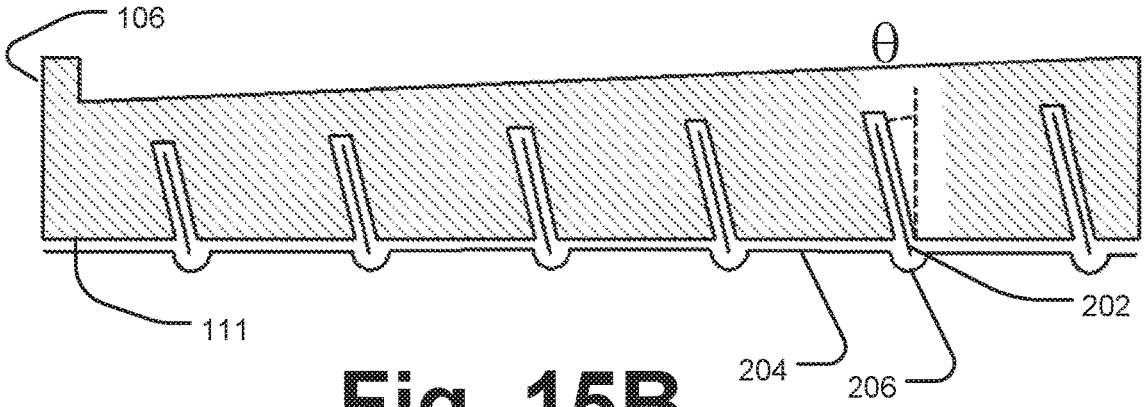

The disclosed shock structures 114, which in some embodiments may be positioned between shock cavities 112, may further define a second cavity 200. The embodiments in FIGS. 15A-15B depict these second cavity 200 embodiments. As shown in FIG. 15A, the first layer 106 of an insole 102 may have the second shock cavities 200 that extend from the lower surface 111 of the first layer 106 of the insole 102 and may define a depth that is the same or similar to the depth of the shock cavities 112 of earlier embodiments. In some embodiments, the second shock cavities 200 have a width or depth that is less or smaller than that of the shock cavities 112. In some embodiments, a displacement translator 202 may be inserted into the second shock cavity 200. The displacement translator 202 may be a substantially flat structure (similar to the leaf spring 190 of FIGS. 12A-12B). The displacement translator 202 may be connected to or affixed to a support structure 204, such as a sole support. As shown in FIG. 15B, the support structure 204 may have a plurality of pivots 206 positioned between one or more adjacent shock cavities 200. The pivot 206 embodiment may enable the attachment of a displacement translator 202 to a fixed location by means of a hinge mechanism so as to allow the secondary displacement translator 202 to rotate. The pivot 206 mechanism may be a complementary structure of the displacement translator 202 and thus allows the displacement translator 202 to sit within and rotate about the pivot 206. The pivots 206 may aid in allowing the displacement translator 202 to rotate with, flex, or bend and may aid in translating the flex or bend (and subsequent displacement of the support) to other displacement translators 202. In some embodiments, the second cavity 200 may be referred to as a secondary displacement translator slot, and the displacement translator may be referred to as a secondary displacement translator (SDT). In some embodiments, the displacement translator may not include a second cavity 200, and it may use a shock cavity in place of the second cavity 200. A shock cavity may have both an SDT and a shock insert.

Figure 16A:
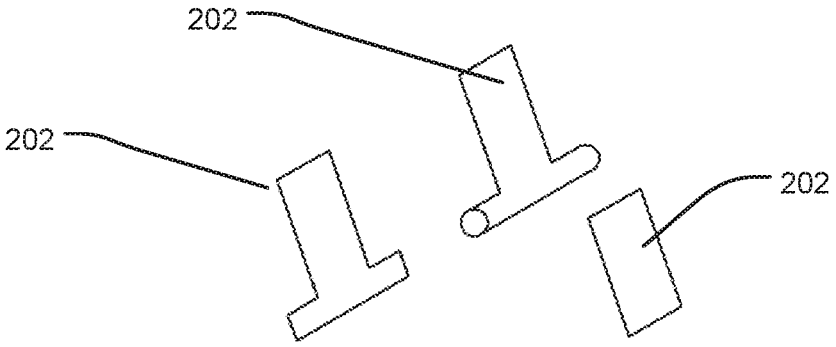
FIGS. 16A-16C are representative embodiments of one type of disclosed secondary displacement translators.
Figure 16B:
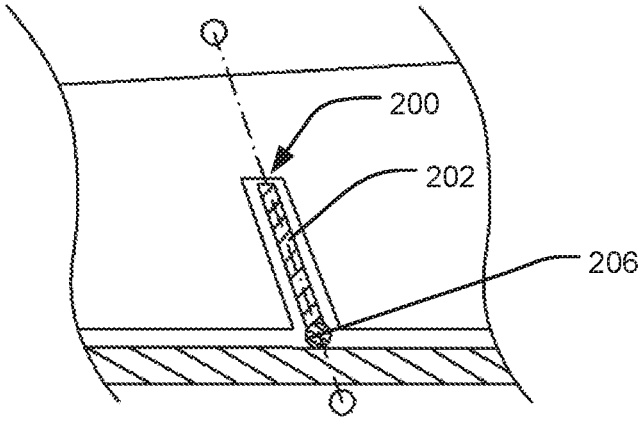
Figure 16C:
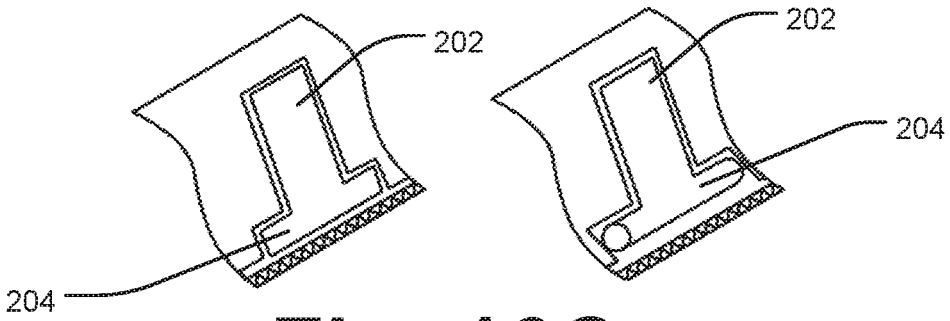

Exemplary embodiments of secondary displacement translators 202 are depicted in FIG. 16A. FIG. 16A shows two embodiments of displacement translators 202, one flat and one "3D." In these embodiments, the first end of the displacement translator 202 is wider than the second end. In these embodiments, shown in FIG. 16C, the end nearest the top surface of the sole is narrower than the end furthest from the top surface of the sole. The end at or near the surface may be positioned at or near an outer sole.

Figure 17A:
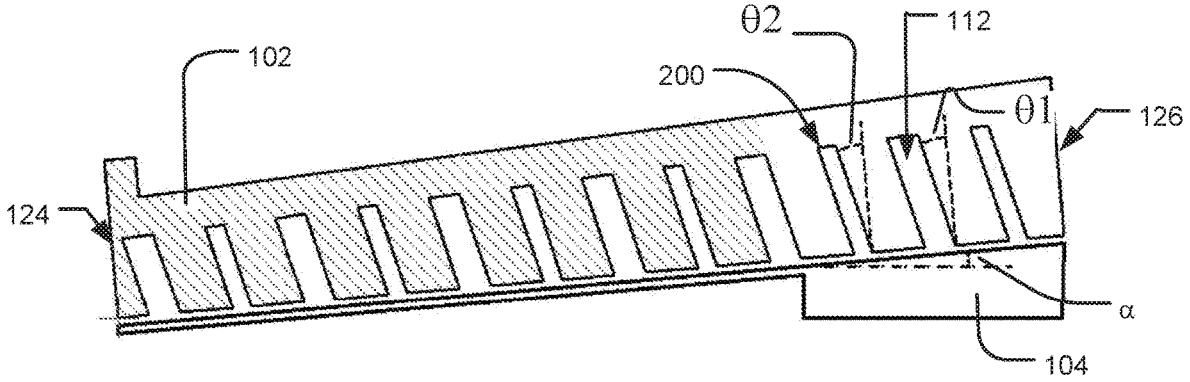
FIGS. 17A-17B are representative embodiments of a sole according to the present disclosure.
Figure 17B:
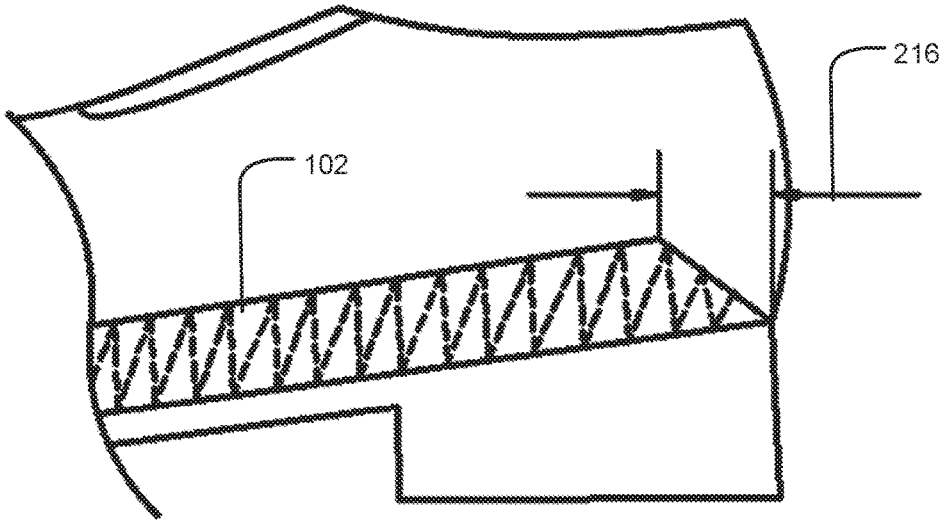

FIGS. 17A-17B further provide a description for calculating different aspects of the angle of the shock cavities 112, 200 of the contemplated designs based upon certain parameters of an embodiment. θ1 may be the angle as measured from vertical of a shock cavity 112. θ2 may be the angle as measured from vertical of a second shock cavity 200. Angle α may be the angle from horizontal of the slope of the insole with respect to the heel. In many embodiments, angle θ1 and θ1 may be from about 0 to about 45 degrees. 17B shows how the insole 102 may compress and deform when exposed to a load such that the practical displacement 216 may be measured.

Figure 18A:
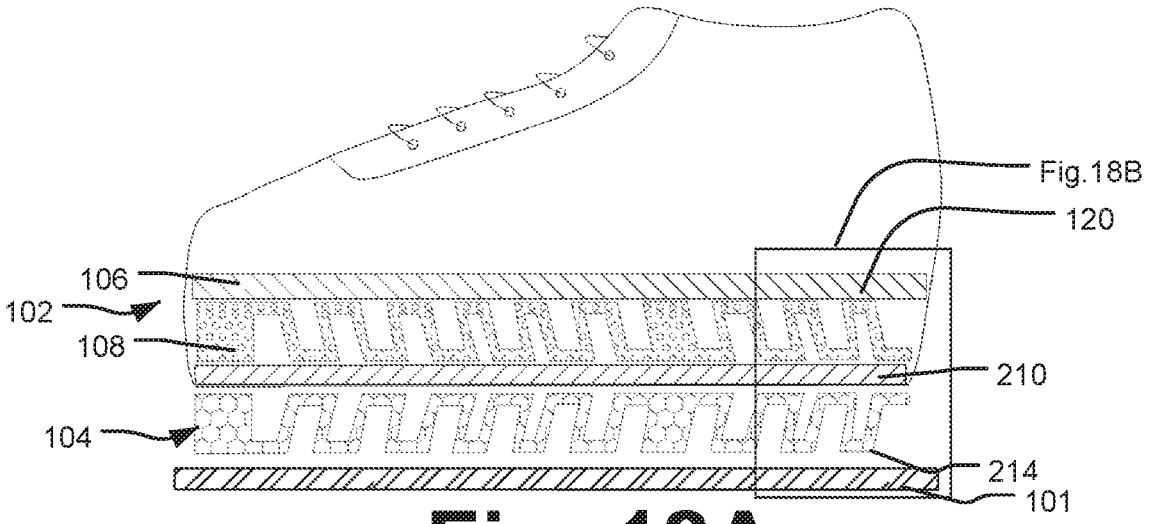
FIGS. 18A-18B are an example of a shoe having various features according to the present disclosure.
Figure 18B:
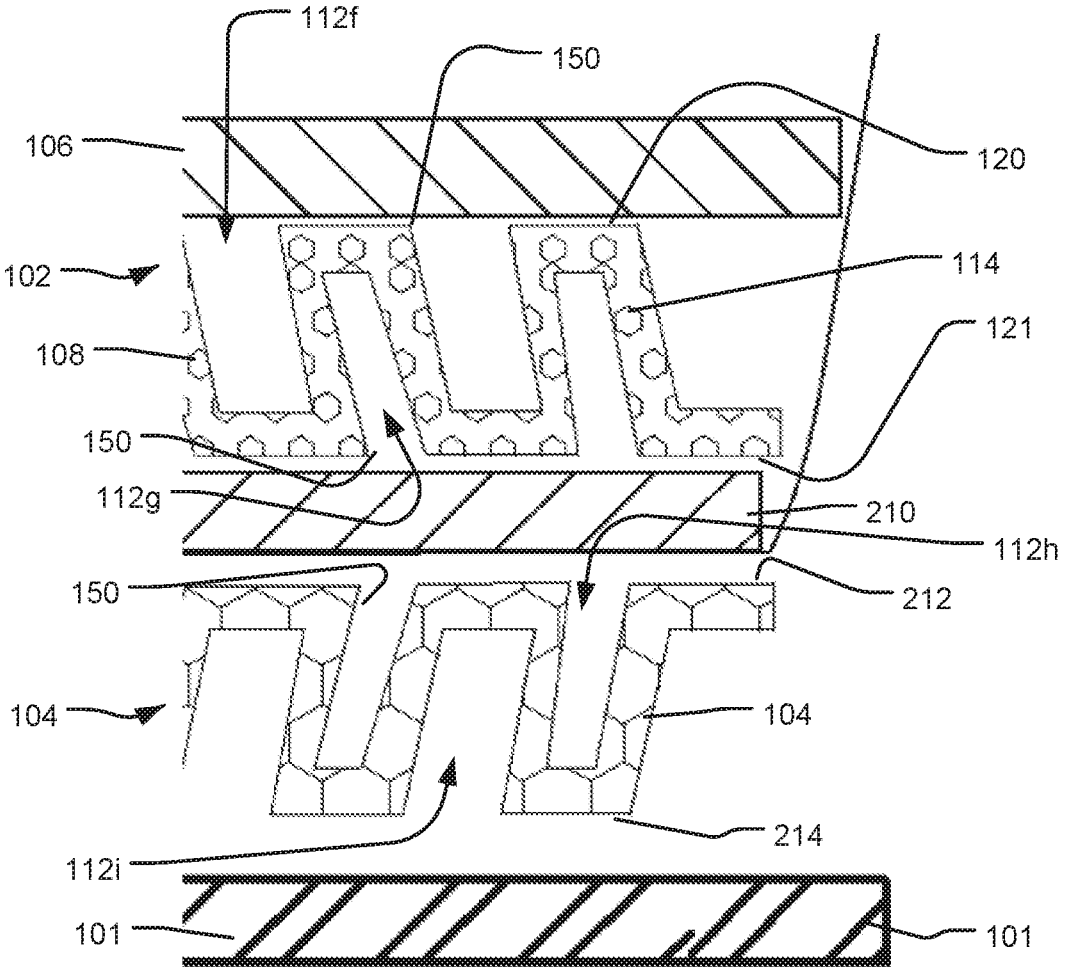

FIGS. 18A-21B show various shoes incorporating various embodiments of the current disclosure to aid in understanding of how the different improvements may be positioned within a single shoe. FIG. 18A shows a shoe adjacent the ground 101 with an insole 102 and an outsole 104 separated by a barrier 210. FIG. 18B is an enlarged view of a portion of FIG. 18A. The insole 102 may have a first layer 106 and a second layer 108. In the embodiment of FIG. 18A, the first layer 106 does not have any shocks 114 or shock cavities 112. The second layer 108 has both shocks 114 and shock cavities 112. Some shock cavities 112*f* may be formed through openings 150 between shocks 114 in the upper surface 120 of the second layer 108. Some shock cavities 112*g* may be formed through openings 150 between shocks 114 formed in the lower surface 121 of the second layer 108. The outsole 104 of the shoe may have an upper surface 212 and a lower surface 214. Shock cavities 112*h* may be formed through openings 150 between shocks 114 in the upper surface 212. Shock cavities 112*i* may be formed through openings between shocks 114 in the lower surface 214. The lower surface 214 of the outsole 104 may be adjacent the ground 101.

Figure 19A:
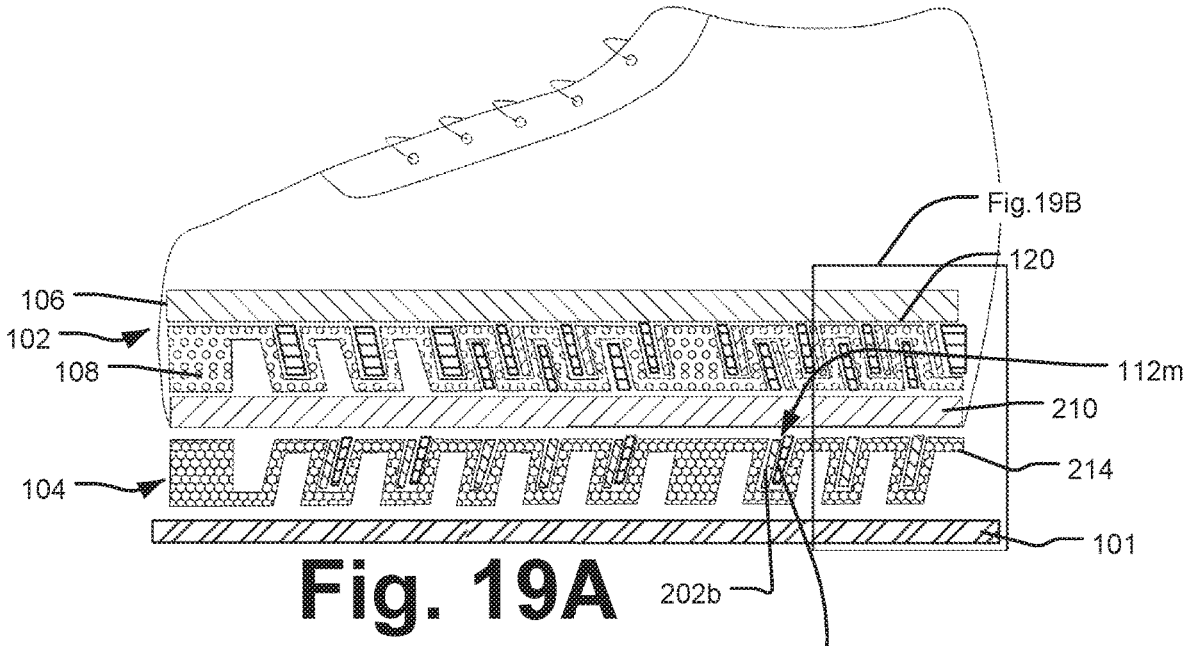
FIGS. 19A-19B are another example of a shoe having various features according to the present disclosure.
Figure 19B:
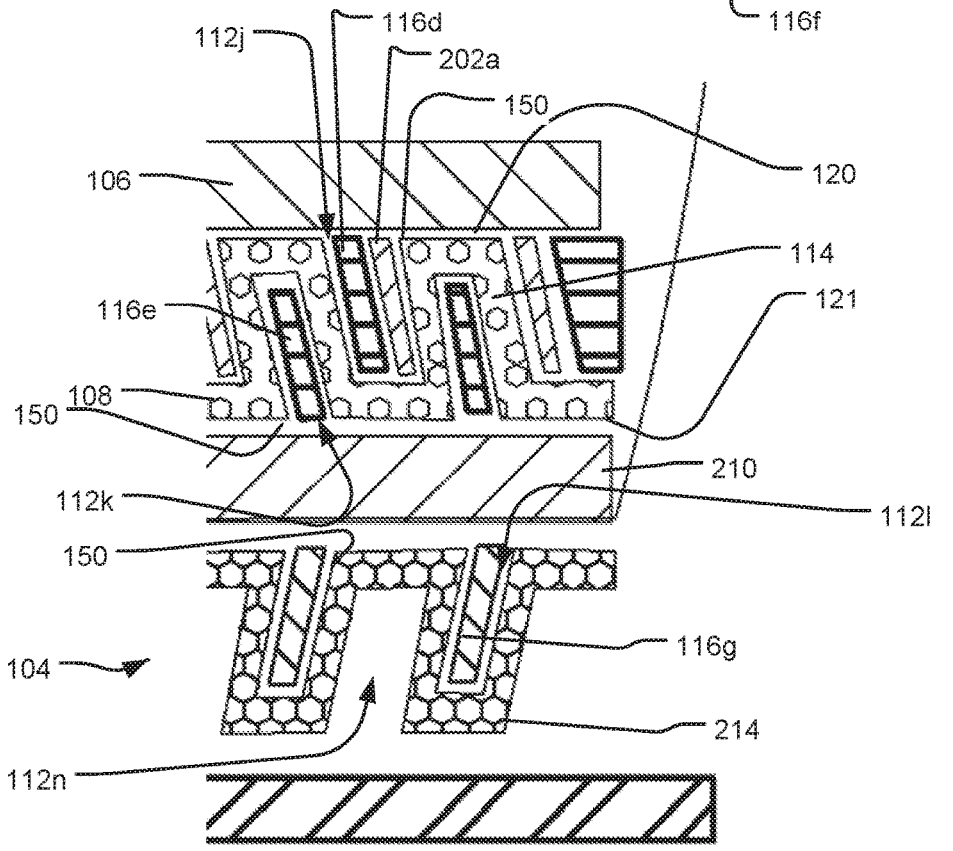

FIG. 19A-19B show another embodiment of a shoe with an insole 102 and an outsole 104. FIG. 19B is an enlarged view of a portion of FIG. 19A. The first layer 106 of insole 102 may have no shocks 114 or shock cavities 112. The second layer 108 of insole 102 may have a plurality of shocks 114, shock cavities 112, shock cavity inserts 116, and displacement translators 202. The shocks 114 shown in FIGS. 19A-19B may have a variety of widths or thicknesses. In addition, some shock cavities, formed through the openings 150 between the shocks 114 may have a variety of widths. Shock cavity 112*j* may be formed through opening 150 in the upper surface 120 of the second layer 108, and a shock cavity insert 116*d* and a displacement translator 202*a* may be positioned within the shock cavity 112*j*. In another example, shock cavity 112*k* may be formed through opening 150 in the lower surface 121 of the second layer 108, and only a shock cavity insert 116*e* may be positioned within or adjacent to it. Outsole 104 may have shock cavities 112*l* and 112*m* formed through openings 150 in the upper surface 212. Shock cavity 112*m* may be filled with shock cavity insert 116*f* and displacement translator 202*b*. Shock cavity 112*l* may only be filled or adjacent to shock cavity insert 116*g*. Shock cavity 112*n* may be formed through openings 150 in the lower surface 214 between shocks 114. In some embodiments, a secondary displacement translator may be inserted through opening 150 in the lower surface 121 of the second layer 108.

Figure 20A:
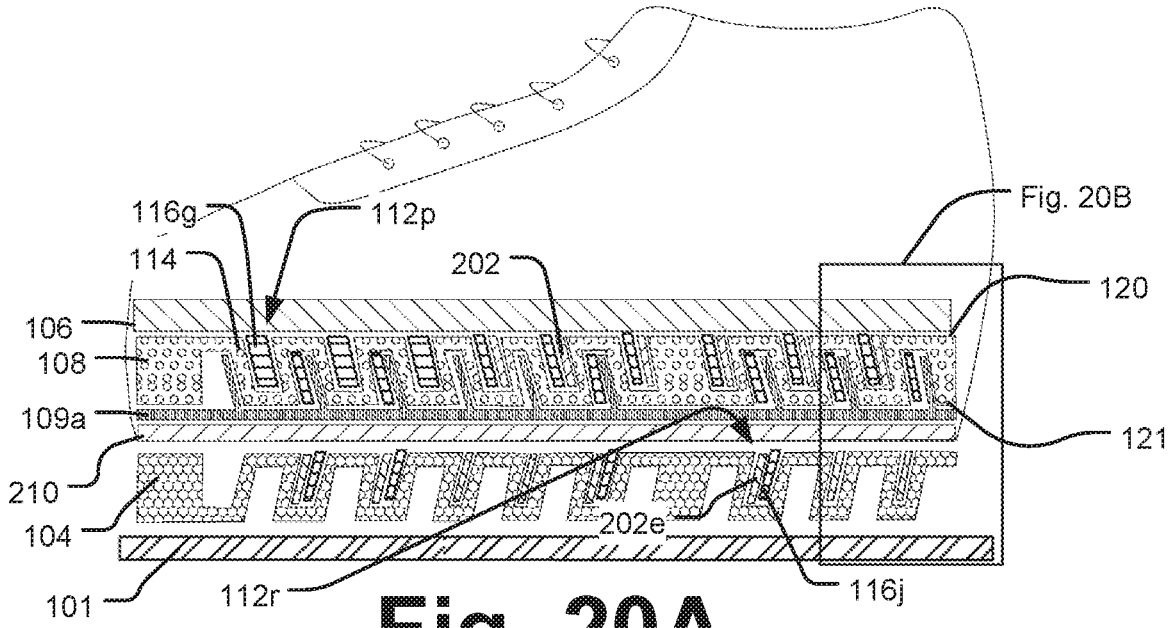
FIGS. 20A-20B are another example of a shoe having various features according to the present disclosure.
Figure 20B:
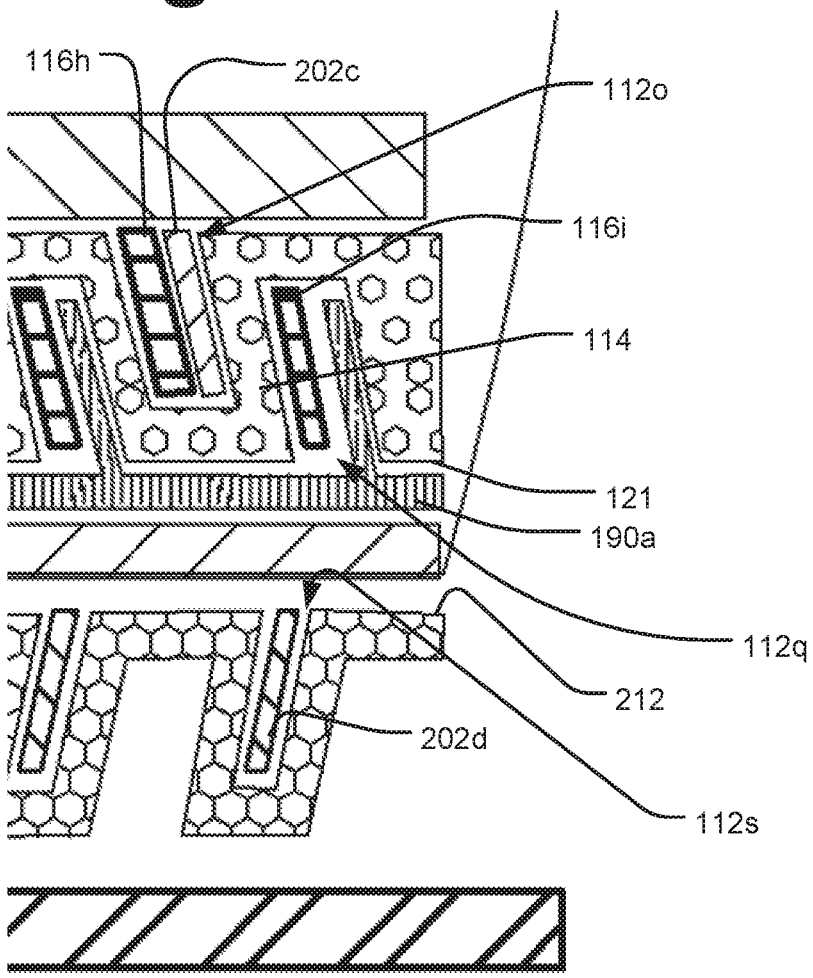

FIGS. 20A-20B show another embodiment of a shoe with an insole 102 and an outsole 104. The second layer 108 may have a plurality of shocks 114 and shock cavities 112 formed between. For example, shock cavity 112*p* may be formed in the upper surface 120 between shocks 114 and have shock cavity insert 116*g* positioned within. Shock cavity 112*o* (FIG. 20B) may also be formed in the upper surface 120 between shocks 114 and have shock cavity insert 116*h* and secondary displacement translator 202*c* positioned within. The lower surface 121 may be positioned adjacent a leaf spring system 190. Shock cavity 112*q* may be formed in the lower surface 121 between shocks 114 and have shock cavity insert 116*i* and a portion of the leaf spring 190*a* positioned within. The outsole 104 may have shock cavities 112*s* (FIG. 20B) formed in the upper surface 212 with secondary displacement translators 202*d* positioned within. The outsole 104 may also have shock cavities 112*r* formed in the upper surface 212 with shock cavity inserts 116*j* and secondary displacement translators 202*e* positioned within.

Figure 21A:
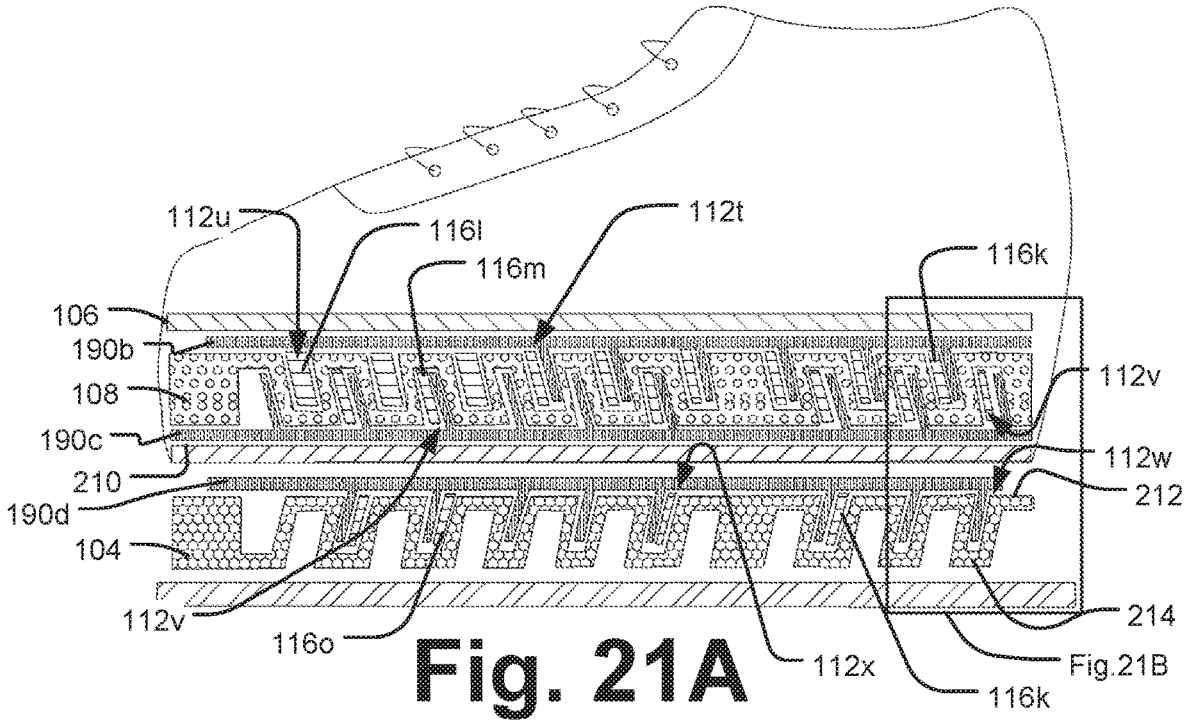
FIGS. 21A-21B are another example of a show having various features according to the present disclosure.
Figure 21B:
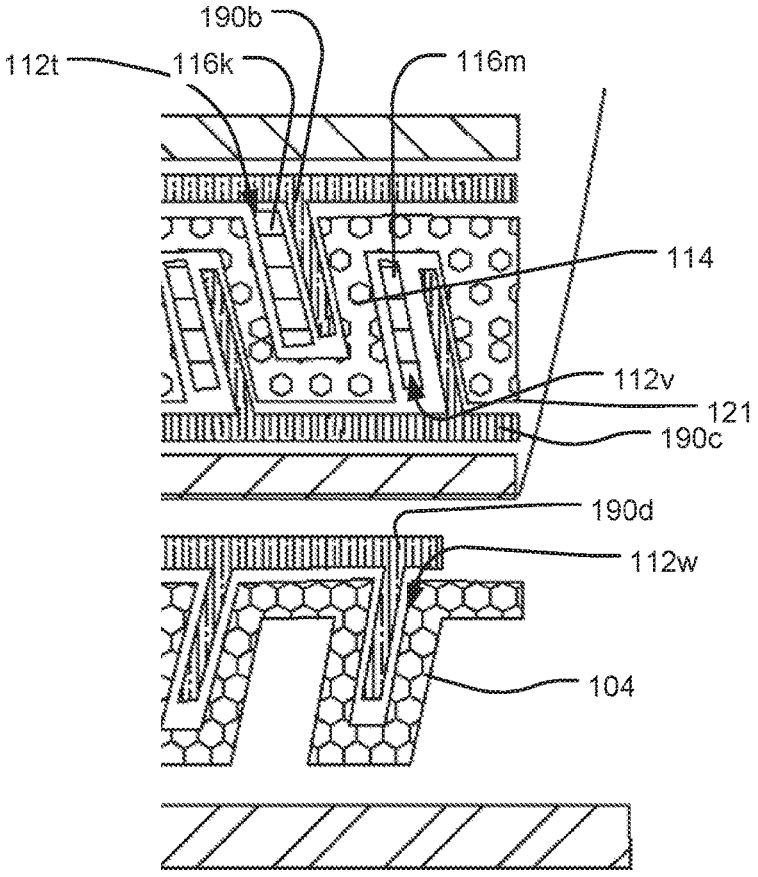

FIGS. 21A-21B show another embodiment of a shoe with an insole 102 and an outsole 104. The second layer 108 may have a plurality of shocks 114 and shock cavities 112 formed between. Leaf spring system 190*b* may be positioned between the first layer 106 and the second layer 108. A portion of the leaf spring 190*b* may be positioned within shock cavity 112*t* along with shock cavity insert 116*k*. In some examples, shock cavity 112*u* may have only shock cavity insert 116*l* positioned within it. Leaf spring system 190*c* may be positioned between the second layer 108 and the barrier 210. Shock cavity 112*v* may extend from the lower surface 121 of second layer 108 and have a portion of leaf spring system 190*c* and 116*m* positioned within. Leaf spring system 190*d* may be positioned between the barrier 210 and the upper surface 212 of the outsole 104. Shock cavities 112*x* may have a portion of the leaf spring system 190*d* and 116*o* positioned within. Some shock cavities 112*w* may only have the portion of the leaf spring 190*d* positioned within.

Swappable Insole

Yet another embodiment is wherein the insoles can be swapped between different degrees of firmness from relatively soft to extra firm. The ability to swap the insole gives a user the ability to experience a range of foot sensations up to feel of barefoot walking or running. If insole is extra firm and flat, It can give a feeling of walking or running barefooted, regardless of shoe fitting.

Bumpered Insoles

Another aspect of the current disclosure is an embodiment that allows a user to convert larger insoles to fit smaller shoes, and to convert larger shoes sizes to fit smaller feet. The purpose of this innovation is to initially reduce tooling costs by reducing number of manufactured shoe sizes and also reduce inventory costs. A strip of padding bumper can be added to the top surface of an insole on the front side of the toes along the insole's front (toe side) circumference. In one embodiment, the bumper may cover a lateral depth of up to ½ or 1 shoe size corresponding to shoe size of 9½ and 9, as an example. In another embodiment, the bumpered insole would also comprise integral cutting marks at the front and the rear of the insole to allow for the original insole to be trimmed down to accommodate a smaller shoe size.

While multiple embodiments are disclosed, still other embodiments of the present disclosure will become apparent to those skilled in the art from the following detailed description. As will be apparent, the disclosure is capable of modifications in various obvious aspects, all without departing from the spirit and scope of the present disclosure. Accordingly, the detailed description is to be regarded as illustrative in nature and not restrictive.

All references disclosed herein, whether patent or nonpatent, are hereby incorporated by reference as if each was included at its citation, in its entirety. In case of conflict between reference and specification, the present specification, including definitions, will control.

Although the present disclosure has been described with a certain degree of particularity, it is understood the disclosure has been made by way of example, and changes in detail or structure may be made without departing from the spirit of the disclosure as defined in the appended claims.

What is claimed is:

1. A method of increasing the comfort of a shoe, comprising:

providing a sole of the shoe, the sole having a top surface, an inner surface, a heel end and a toe end, wherein the sole includes a first material having a first shock absorption property; and altering the first shock absorption property of the sole by creating a plurality of shock cavities within the sole, wherein each of the plurality of shock cavities defines the inner surface within the sole, each of the plurality of shock cavities extending away from the inner surface, wherein:

the plurality of shock cavities form a plurality of shocks disposed throughout the sole between the toe end and the heel end, wherein the shocks define a first end positioned at or near the inner surface of the sole and a second end positioned away from the first surface of the sole, each of the plurality of shocks extends away from the inner surface, and each of the plurality of shocks extending away from the inner surface of the sole at a first shock angle, wherein when the sole is in a compressed position, the shock cavity collapses and the sole is configured to redirect a heel of a user's foot away from a heel end of the shoe to reduce contact of the heel of the user's foot with the shoe; and wherein the sole is an insole configured to be positioned within the shoe, wherein the insole is configured to lie along a footbed of the shoe, the top surface of the layer of the insole is configured to contact a user's foot, and the second ends of the respective shocks are configured to contact the footbed.

2. The method of claim 1, further comprising inserting a plurality of shock cavity inserts into the respective plurality of shock cavities to further alter the first shock absorption property.

3. The method of claim 2, wherein at least one of the shock cavity inserts of the plurality of shock cavity inserts defines a retaining structure configured to retain the at least one of the plurality of shock cavity inserts within the sole.

4. The method of claim 3, wherein at least one of the shock cavity inserts of the plurality of shock cavity inserts includes:

an upper portion disposed near the inner surface of the sole; and a lower portion disposed distal from the inner surface of the sole, wherein the upper portion has a larger dimension than a dimension of the lower portion thereby defining the retaining structure.

5. The method of claim 2, wherein at least one of the shock cavity inserts of the plurality of shock cavity inserts is secured in the sole by a connection apparatus.

6. The method of claim 5, wherein the connection apparatus comprises one of an adhesive, a screw lock, a snap lock, or a pressure lock.

7. The method of claim 2, wherein each of the plurality of shock cavity inserts defines a first shock cavity angle.

8. The method of claim 2, further comprising inserting a displacement translator into at least one shock cavity of the plurality of shock cavities.

9. The method of claim 8, wherein the displacement translator is one or a plurality of leaf springs included in a leaf spring system, wherein the plurality of leaf springs extend from a substrate below the sole into the respective plurality of shock cavities.

10. The method of claim 2, wherein the plurality of shock cavity inserts are made of a second material having a second shock absorption property.

11. The method of claim 10, wherein the first shock absorption property and the second shock absorption property are similar.

12. The method of claim 10, wherein the first material and the second material are the same.

13. The method of claim 10, wherein the second material includes a plurality of materials.

14. The method of claim 1, wherein at least two shock cavities of the plurality of shock cavities are dissimilarly shaped.

15. The method of claim 1, wherein each of the plurality shocks defines a first end positioned at or near the inner surface of the sole and a second end positioned away from the inner surface of the sole, wherein each of the plurality shocks are connected to each other at the second end.

16. The method of claim 1, further comprising providing a toe bumper positioned at the toe end of the sole and extending away from the top surface in a direction away from the inner surface.

17. The method of claim 1, wherein the first shock angle is between 0 degrees and 45 degrees.

18. The method of claim 1, wherein the plurality or shock cavities are cylindrical.

* * * * *